US010350917B2

(12) United States Patent
Inoue et al.

(10) Patent No.: US 10,350,917 B2
(45) Date of Patent: Jul. 16, 2019

(54) TAPE CARTRIDGE AND PRINTING APPARATUS USING THE SAME

(71) Applicant: Brother Kogyo Kabushiki Kaisha, Nagoya-shi, Aichi-ken (JP)

(72) Inventors: Harumitsu Inoue, Toki (JP); Shimako Nakai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/718,216

(22) Filed: Sep. 28, 2017

(65) Prior Publication Data

US 2018/0015749 A1 Jan. 18, 2018

Related U.S. Application Data

(63) Continuation of application No. PCT/JP2016/070992, filed on Jul. 15, 2016.

(30) Foreign Application Priority Data

Jul. 24, 2015 (JP) ..... 2015-146727

(51) Int. Cl.

| | |
|---|---|
| ***B41J 15/04*** | (2006.01) |
| ***B41J 3/36*** | (2006.01) |
| ***G09F 3/02*** | (2006.01) |
| ***B41J 3/407*** | (2006.01) |

(52) U.S. Cl.

CPC ..... *B41J 15/044* (2013.01); *B41J 3/36* (2013.01); *B41J 3/4075* (2013.01); *G09F 3/02* (2013.01)

(58) Field of Classification Search

CPC ... B41J 32/02; B41J 33/10; B41J 35/16; B41J 32/00; B41J 17/32; B41J 3/4075; B41J 3/36; B41J 15/044

See application file for complete search history.

(56) References Cited

U.S. PATENT DOCUMENTS

2018/0015749 A1 1/2018 Inoue et al.

FOREIGN PATENT DOCUMENTS

| | | | |
|---|---|---|---|
| CN | 205890251 | U | 1/2017 |
| JP | H11-105353 | A | 4/1999 |
| JP | 2003-058062 | A | 2/2003 |
| JP | 2004-114550 | A | 4/2004 |
| JP | 2010-008944 | A | 1/2010 |

(Continued)

OTHER PUBLICATIONS

Feb. 8, 2018—(WO) IPRP—App PCT/JP2016/070992.

(Continued)

*Primary Examiner* — Kristal Feggins

(74) *Attorney, Agent, or Firm* — Banner & Witcoff, Ltd.

(57) ABSTRACT

A tape cartridge includes a casing and a tape roll which is a winding of a tape and is accommodated in the casing. The tape includes a first sheet and a second sheet. The first sheet is in a form of an elongated sheet-like shape having a first surface and a second surface opposite to the first surface. The first sheet has translucency. The second sheet is in a form of an elongated sheet-like shape and affixed to the first surface of the first sheet. The second sheet includes a label portion and a non-label portion segmented from each other by a cut line. The second sheet has translucency. The second surface of the first sheet is provided with a mark at a position adjacent to the cut line.

17 Claims, 24 Drawing Sheets

(56) References Cited

FOREIGN PATENT DOCUMENTS

JP 2010-195021 A 9/2010

OTHER PUBLICATIONS

Oct. 4, 2016—International Search Report—Intl App PCT/JP2016/070992.
Jan. 30, 2018—(WO) IPRP—App PCT/JP2016/070992.
Dec. 3, 2018—(CN) Notification of First Office Action—App 201680031720.1.
Mar. 28, 2019—(EP) Extended Search Report—App 16830352.7.

TAPE CARTRIDGE AND PRINTING APPARATUS USING THE SAME

CROSS REFERENCE TO RELATED APPLICATION

This application is a continuation application of International Application PCT/JP2016/070992 filed Jul. 15, 2016, which claims priority from Japanese Patent Application No. 2015-146727 filed Jul. 24, 2015. The entire contents of the earlier applications are incorporated herein by reference.

TECHNICAL FIELD

The present disclosure relates to a tape cartridge provided with a tape roll around which a tape is wound and a printing apparatus that performs printing on the tape.

BACKGROUND

There are conventionally known printers for printing desired characters and graphics on a tape having a cut (see Patent Document 1). The tape is composed of a first sheet (base sheet) whose face side is applied with releasing agent and a strip-like first sheet (printing sheet) affixed to the face-side surface of the first sheet. The back-side surface of the second sheet is applied with adhesive agent, and the face-side thereof is subjected to printing. The second sheet is divided into a label portion and a non-label portion by the cut.

SUMMARY

When printing is performed using the above-described tape, only the label portion of the second sheet is peeled off from the first sheet with the non-label portion left on the first sheet and is affixed to an adherend. However, the peel-off position of the label portion on the second sheet may be hard to visually distinguish depending on the form of the cut or material of the second sheet.

The object of the present disclosure is to provide a tape cartridge and a printing apparatus in which the label portion can be easily peeled off to enhance user convenience.

According to one aspect, the present disclosure provides a tape cartridge including a casing and a tape roll which is a winding of a tape and is accommodated in the casing. The tape includes a first sheet and a second sheet. The first sheet is in a form of an elongated sheet-like shape having a first surface and a second surface opposite to the first surface. The first sheet has translucency. The second sheet is in a form of an elongated sheet-like shape and affixed to the first surface of the first sheet. The second sheet includes a label portion and a non-label portion segmented from each other by a cut line. The second sheet has translucency. The second surface of the first sheet is provided with a mark at a position adjacent to the cut line.

According to another aspect, the present disclosure provides a tape cartridge including a casing including a side wall portion and a tape roll which is a winding of a tape and is positioned in the casing. The tape includes a first sheet in a form of an elongated sheet-like shape and having a first surface and a second sheet in a form of an elongated sheet-like shape and affixed to the first surface of the first sheet. The second sheet includes a label portion and a non-label portion segmented from each other by a cut line. The label portion is not subjected to printing, and a mark is provided on the non-label portion at a position adjacent to the cut line.

According to another aspect, the present disclosure provides a printing apparatus including a conveying portion, a printing portion, and a controller. The conveying portion is configured to convey a tape. The tape includes a first sheet in a form of an elongated sheet-like shape and having a first surface, and a second sheet in a form of an elongated sheet-like shape and affixed to the first surface of the first sheet. The second sheet includes a label portion and a non-label portion segmented from each other by a cut line. The printing portion is configured to perform printing on the tape conveyed by the conveying portion. The controller is configured to control the conveying portion and the printing portion to print a mark on the non-label portion in the second sheet. The mark is printed adjacent to the cut-line.

BRIEF DESCRIPTION OF THE DRAWINGS

The particular features and advantages of the disclosure will become apparent from the following description taken in connection with the accompanying drawings, in which.

DETAILED DESCRIPTION

An embodiment of the present disclosure will be described referencing to figures. In the following description, the front, rear, left, right, top, and bottom in the description will be respectively referred to as the front, rear, left, right, top, and bottom in the figures, if illustrated.

Following describes a first embodiment of the present disclosure with reference to FIGS. 1 to 15.

Entire Structure of Printer

Figure 1:
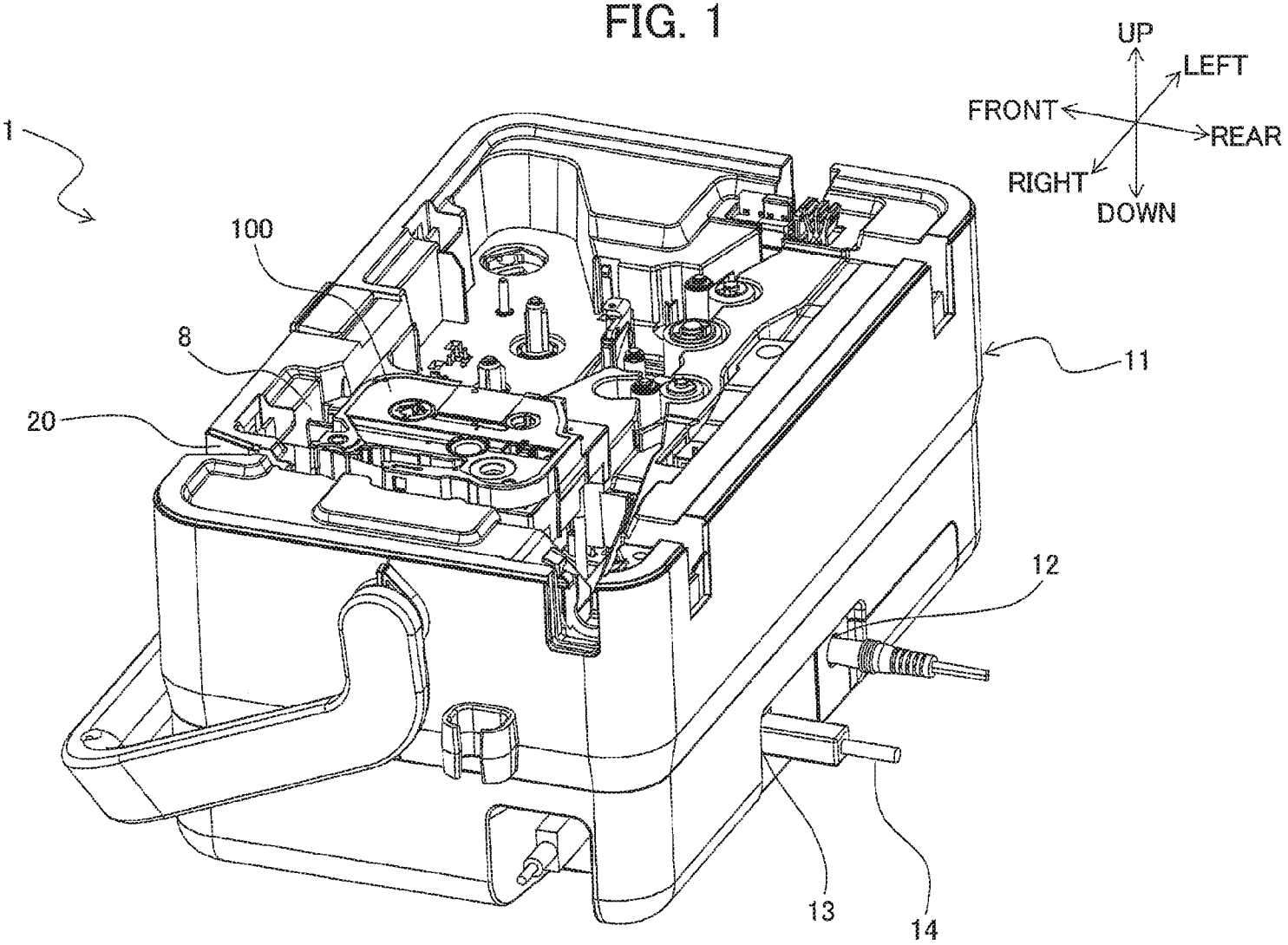
FIG. 1 is a perspective view of a printing apparatus to which a tape cartridge is attached according to a first embodiment of the present disclosure.

In FIG. 1, a printing apparatus 1 according to the present embodiment can selectively execute printing on a printing tape 50 and printing on a printing tube (not illustrated). The printing tape 50 corresponds to a tape described in the claims of the present disclosure. While the printing apparatus 1 can execute both the printing on the printing tape 50 and printing on the printing tube in the above description, it may be configured to execute only the printing on the printing tape 50.

The printing apparatus 1 can use various types of tape cartridges 100 such as a thermal type, a receptor type, and a laminate type. The tape cartridge 100 corresponds to a tape cartridge described in the claims of the present disclosure. Hereinafter, the printing apparatus 1 is assumed to use the tape cartridge 100 of a receptor type. Further, the printing apparatus 1 can use both the tape cartridges 100 of a type (die-cut label type) in which a cut is formed in a printing sheet of the printing tape 50 so as to divide the printing sheet into a label portion and a non-label portion and of a type not having the above cut in the printing sheet of the printing tape 50. In the example of FIG. 1, the tape cartridge 100 of a die-cut label type is used.

The printing apparatus 1 has a substantially rectangular parallelepiped main body part 11 and a cover (not illustrated) that opens/closes an upper opening of the main body part 11. In a state where the cover is attached to the main body part 11 (FIG. 1 shows the printing apparatus 1 uncovered), it is turnably supported at the upper portion of the left end of the main body part 11. A power supply connector 12 and a USB (Universal Serial Bus) connector 13 are provided on the lower portion of the back surface of the main body part 11. The printing apparatus 1 is connected to an operation terminal 300 (see FIG. 4) through a USB cable 14 (see FIG. 4) connected to the USB connector 13. The printing apparatus 1 receives printing data edited in the operation terminal 300 and performs desired printing on the printing tape 50 (see FIGS. 2 and 3) based on the printing data. The printing apparatus 1 and operation terminal 300 may be connected by wireless communication. While the printing apparatus 1 is configured to execute printing based on operation of the operation terminal 300 in the above description, it may be configured to execute printing based on operation in an operation unit provided therein (so-called stand-alone type).

A cartridge holder 8 having a recessed shape to which the tape cartridge 100 provided with the printing tape 50 can be detachably attached is provided at a position close to the right side of the upper surface of the main body part 11. To make clear the structure, the tape cartridge 100 is positioned above the actual mounting position thereof in the cartridge holder 8 in FIG. 1.

A discharge port 20 is provided at a position close to the right side of the front surface of the main body part 11. The printing tape 50 after printing by a thermal head 22 to be described later is discharged while being conveyed by a platen roller 25 to be described later from the cartridge holder 8 to the outside of the printing apparatus 1 through the discharge port 20.

<Internal Structure of Printer>

Figure 2:
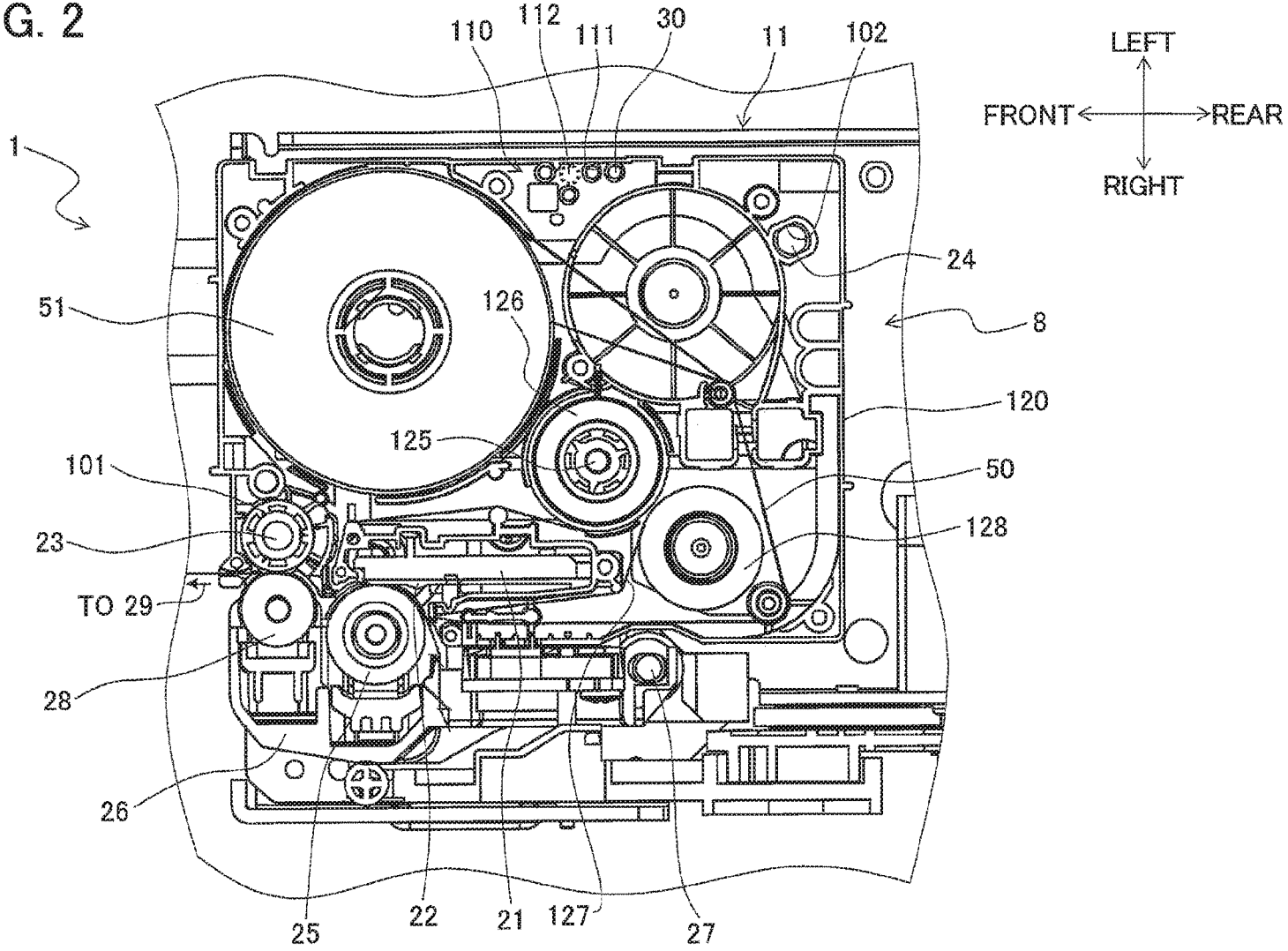
FIG. 2 is a plan view illustrating a cartridge holder to which the tape cartridge of the printing apparatus is attached and a configuration thereof around the cartridge holder.

The internal structure of the printing apparatus 1 will be described. As illustrated in FIGS. 1 and 2 and as described above, the cartridge holder 8 to which the tape cartridge 100 can be detachably attached is provided at the upper portion of the main body part 11. A head holder 21 formed of a plate-like member extending in the front-rear direction is vertically installed at a position close to the right side of substantially the center portion of the cartridge holder 8 in the front-rear direction. A thermal head 22 (corresponding to a printing part) provided with heating elements (not illustrated) is provided on the right side surface of the head holder 21. The thermal head 22 uses an ink ribbon 127 to be described later to perform printing on the printing tape 50 supplied from the tape cartridge 100 and conveyed by a platen roller 25 along a predetermined conveying path.

A ribbon winding shaft 125 is vertically installed to the left of the head holder 21. The ribbon winding shaft 125 is fitted into the inside of a ribbon winding roller 126 provided in the tape cartridge 100 and drives the ribbon winding roller 126 into rotation. The tape cartridge 100 further has a rotatably supported ink supply side roll 128. An ink ribbon 127 is wound around the ink supply side roll 128. The ribbon winding roller 126 is driven into rotation by the ribbon winding shaft 125 to pull out the ink ribbon 127 from the ink supply side roll 128 and wind the used ink ribbon 127.

A feed roller drive shaft 23 (corresponding to a conveying part) is vertically installed to the front of the head holder 21. The feed roller drive shaft 23 is a shaft body that can be detachably attached to a feed roller 101 of the tape cartridge 100. A guide shaft 24 is vertically installed at a position close to the left corner of the cartridge holder 8. The guide shaft 24 is a shaft body that can be detachably attached to a guide hole 102 of the tape cartridge 100.

A drive motor 66 (see FIG. 3) as a stepping motor is disposed below the cartridge holder 8 of the main body part 11. The feed roller drive shaft 23 and a platen roller 25 to be described later are connected to the drive motor 66 through a plurality of unillustrated gears. With the drive of the drive motor 66, the ribbon winding shaft 125 (ribbon winding roller 126), feed roller drive shaft 23 (feed roller 101), and a platen roller 25 are rotated.

A cartridge sensor 31 (see FIG. 4) having a plurality of (five, in this example) vertically installed push-down sensor projections 30 are provided on a lower support surface on the left side of substantially the center of the cartridge holder 8 in the front-rear direction. When the tape cartridge 100 is attached to the cartridge holder 8, a detected part 110 (the details thereof will be described later) provided in the tape cartridge 100 faces the sensor projections 30, and one sensor projection 30 corresponding to the type (in other words, corresponding to a combination of the width and color of the printing tape 50) of the tape cartridge 100 is selectively pushed down. The cartridge sensor 31 outputs a detection signal indicating type information (in other words, tape width and tape color) of the tape cartridge 100 based on a combination of ON and OFF of the sensor projections 30.

An arm-like platen holder 26 extending in the front-rear direction is disposed outside the upper portion of the cartridge holder 8 of the main body part 11. The platen holder 26 is swingably axially supported about a pivot part 27. The platen roller 25 and a pressure contact roller 28 are rotatably axially supported at the front end of the platen holder 26. The platen roller 25 faces the thermal head 22 and can contact and separate from the thermal head 22. The pressure contact roller 28 faces the feed roller 101 and can contact and separate from the feed roller 101. When the platen holder 26 is swung toward the cartridge holder 8 side to move the platen roller 25 to a printing position contacting the thermal head 22, the platen roller 25 presses the thermal head 22 through the printing tape 50. At the same time, the pressure contact roller 28 presses the feed roller 101 through the printing tape 50. In this state, the printing tape 50 in the tape cartridge 100 is conveyed with the rotation of the feed roller 101, platen roller 25, and pressure contact roller 28, whereby printing on the printing tape 50 is performed by the thermal head 22.

<Structure of Cartridge>

Figure 3:
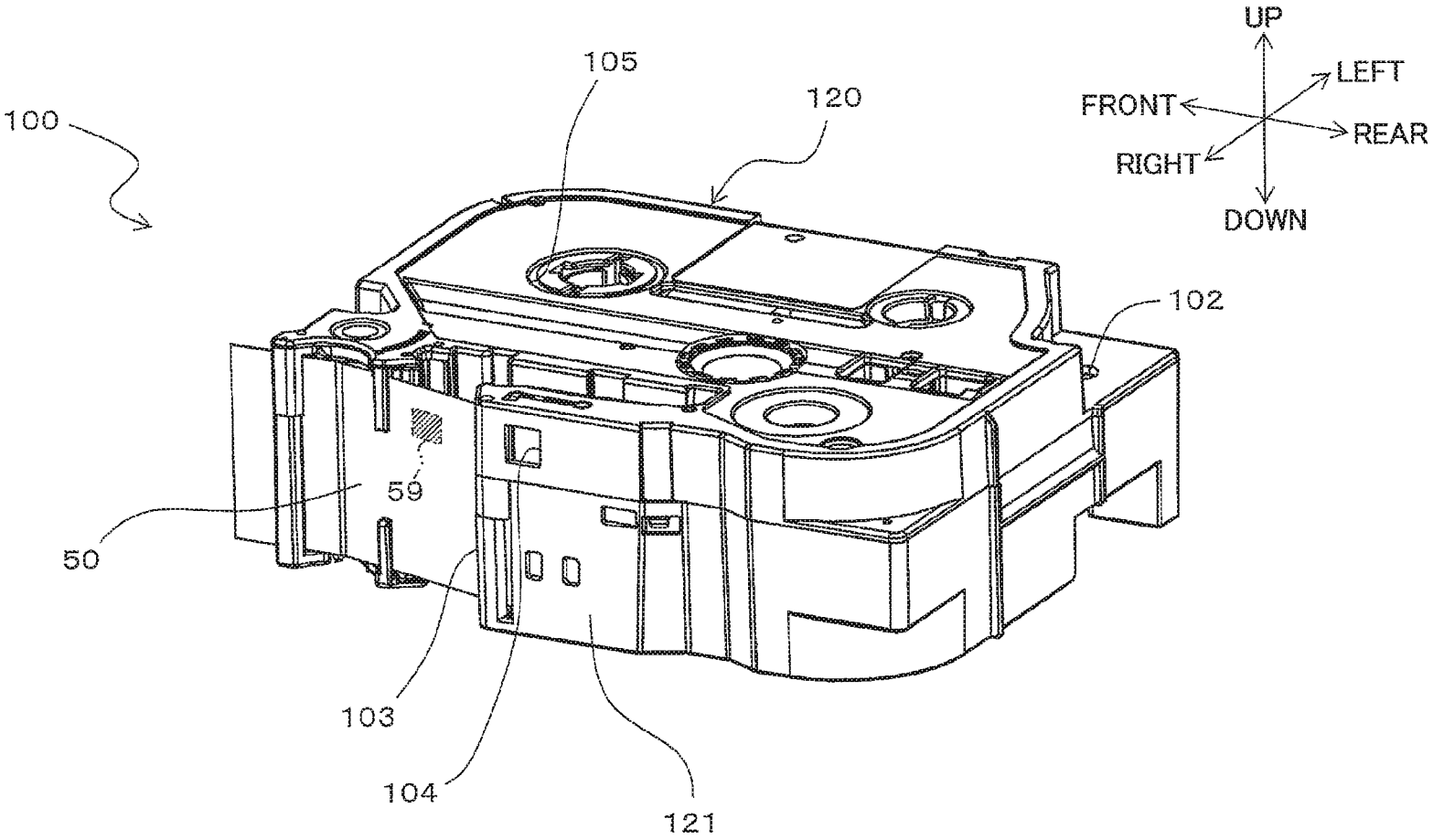
FIG. 3 is a perspective view illustrating a whole exterior of the tape cartridge.

The structure of the tape cartridge 100 will be described with reference to FIGS. 2 and 3. As illustrated in FIG. 3, the tape cartridge 100 has a substantially rectangular parallelepiped (box-like) casing 120 having rounded corners as a whole in a plan view. A tape supply port 103 is provided at the front side of the right surface of the casing 120, and the printing tape 50 is pulled out from the tape supply port 103, so as to be supplied. Further, a through hole 104 for optically detecting a sensor mark 59 to be described later that is previously printed on the printing tape 50 is provided in the vicinity of the upper portion of the tape supply port 103.

A tape roll support hole 105 rotatably supporting, inside the casing 120, a printing tape roll 51 (tape roll) around which the printing tape 50 is wound is provided at the front side upper portion of the casing 120. As illustrated in FIG. 2, the printing tape 50 is pulled out from the printing tape roll 51, subjected to printing by the thermal head 22, and then guided to the discharge port 20 of the main body part 11.

The above-described detected part 110 indicating the type information of the tape cartridge 100 is provided at substantially the front-rear center on the front lower surface of the casing 120. The detected part 110 indicates the type information of the tape cartridge 100 by a combination of an insertion hole 111 and a surface part 112 formed on the lower surface that faces the five sensor projections 30 of the cartridge sensor 31 provided in the main body part 11. As described above, in the present embodiment, the detected part 110 specifies the type information of the tape cartridge 100 including the width and color information of the printing tape 50 in the tape cartridge 100.

The insertion hole 111 is a circular hole and functions as a non-push-down part that does not push down the sensor projection 30 when the tape cartridge 100 is attached to the cartridge holder 8, with the result that the sensor projection 30 facing the insertion hole 111 comes into an OFF state. The surface part 112 functions as a push-down part that pushes down the sensor projection 30 when the tape cartridge 100 is attached to the cartridge holder 8, with the result that the sensor projection 30 facing the surface part 112 comes into an ON state.

<Control Systems for Printer and Operation Terminal>

Control systems for the respective printing apparatus 1 and operation terminal 300 will be described with reference to FIG. 4.

Figure 4:
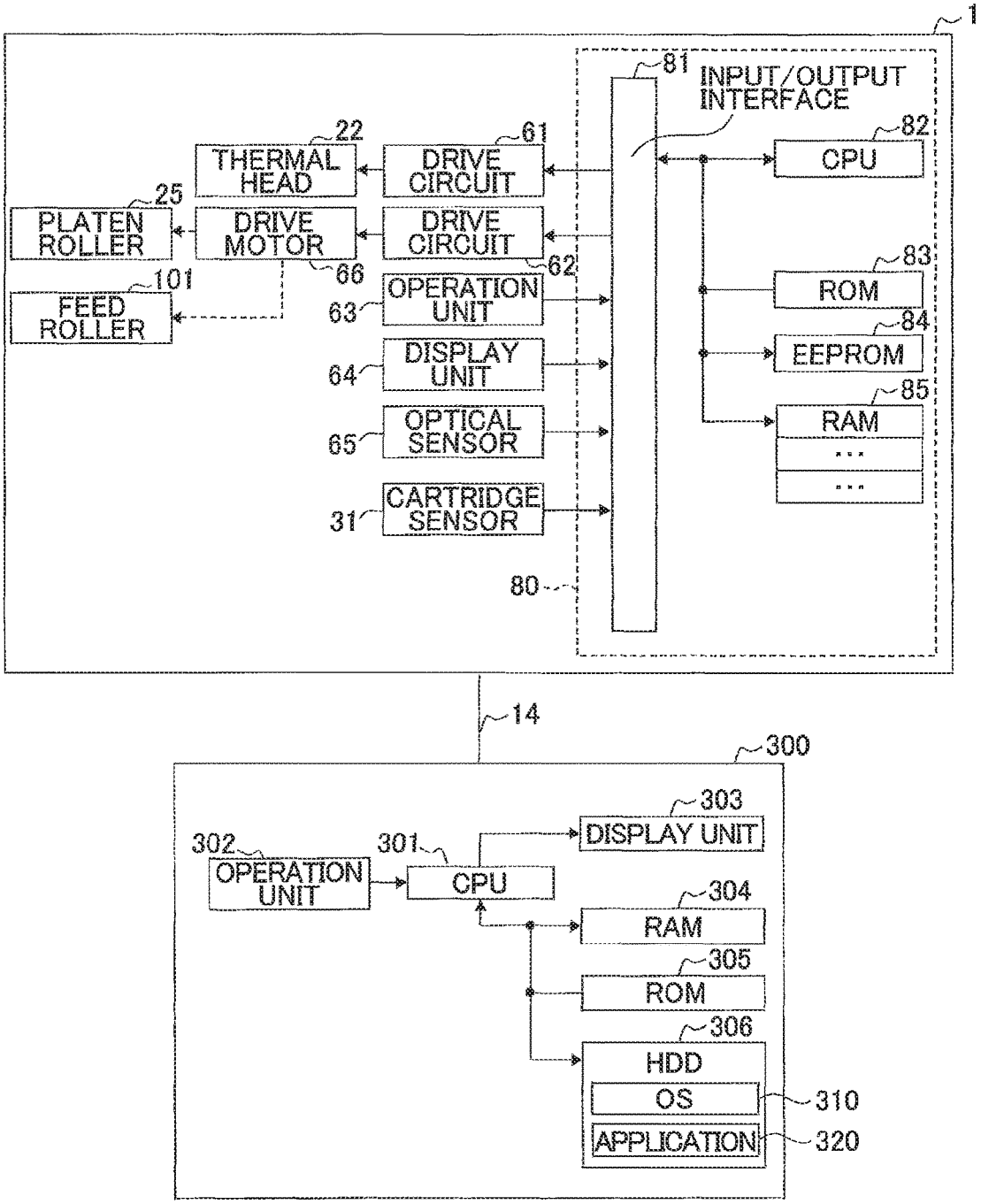
FIG. 4 illustrates a function block diagram indicating functions of the printing apparatus and operation terminal.

As illustrated in FIG. 4, the printing apparatus 1 is provided with a control system having a control circuit 80 (corresponding to a control part) including a CPU 82. In the control circuit 80, the CPU 82 is connected to a ROM 83, an EEPROM 84, a RAM 85, and an I/O interface 81 through a data bus. In place of the EEPROM 84, a non-volatile memory such as a flash memory may be used.

Figure 20:
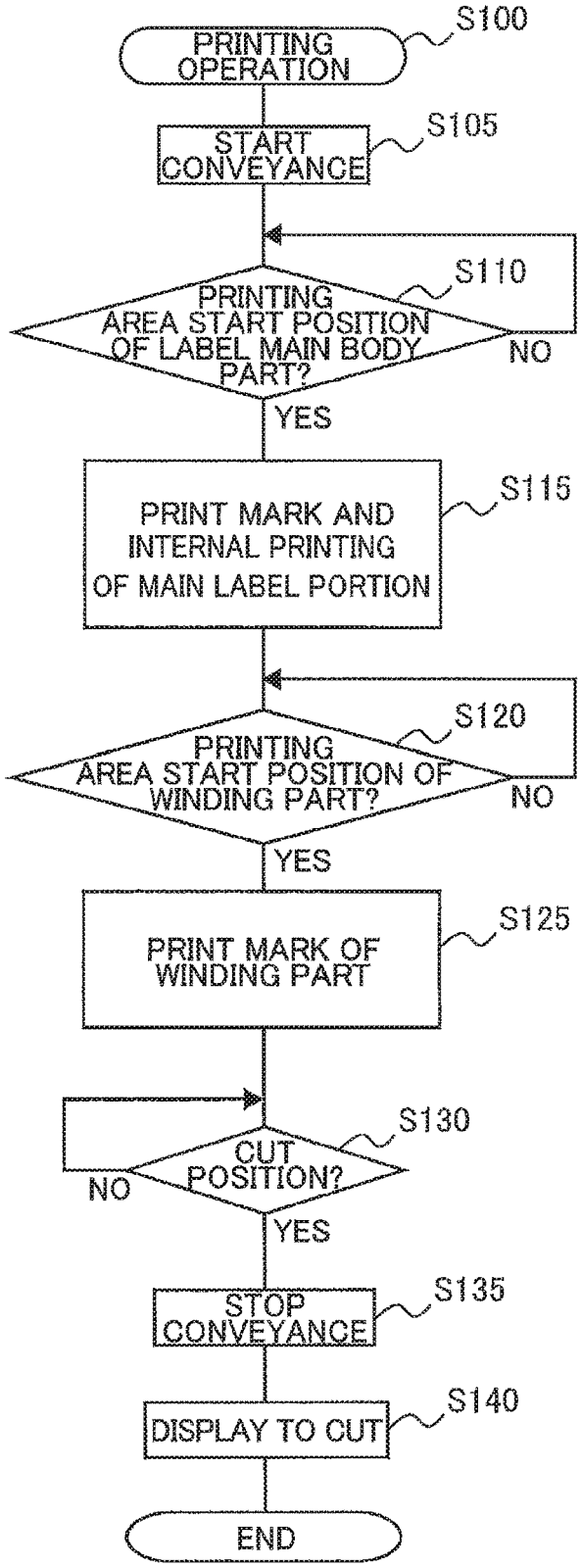
FIG. 20 is a flowchart indicating control procedures that a CPU of the printing apparatus performs.

The ROM 83 stores various programs (e.g., a control program for executing a procedure of the processing flow of FIG. 20) required to control the printing apparatus 1. The CPU 82 performs various computations and processing based on the programs stored in the ROM 83.

The EEPROM 84 stores various kinds of information (e.g., correlation information associating various detection results of the cartridge sensor 31 obtained based on the states of the insertion hole 111 and surface part 112 with the type information of the tape cartridge 100) concerning the printing tape 50 in a non-volatile manner. The CPU 82 refers to the correlation information with respect to the detection result concerning the tape cartridge 100 attached to the cartridge holder 8 to thereby acquire the type information of the currently attached tape cartridge 100.

The RAM 85 temporarily stores results of various computations performed by the CPU 82.

The I/O interface 81 is connected to a thermal head drive circuit 61, a motor drive circuit 62, an operation unit 63, a display unit 64, an optical sensor 65, and the cartridge sensor 31.

The thermal head drive circuit 61 controls the drive of the thermal head 22.

The motor drive circuit 62 controls the drive of the drive motor 66. Thus, as described above, rotation drive force is transmitted to the gear for platen roller and the gear for conveying roller (not illustrated) through the gears (not illustrated) to rotate the platen roller 25 and feed roller 101.

The optical sensor 65 projects sensor light to the printing tape 50 through the through hole 104 formed in the casing 120 of the tape cartridge 100 and detects the presence/absence of its reflected light to thereby detect a conveying state of the printing tape 50. Particularly, when a sensor mark 59 is printed on the printing tape 50, the conveying direction position of the tape can be detected (details thereof will be described later).

As illustrated in FIG. 4, the operation terminal 300 is provided with a control system having a CPU 301. The CPU 301 is connected to an operation unit 302 (first input part, second input part), a display unit 303, a RAM 304, a ROM 305, and an HDD 306.

The operation terminal 300 is connected to the printing apparatus 1 through the USB cable 14 and can thus exchange signals with the printing apparatus 1.

Basic control of the operation terminal 300 is performed by an OS (Operating System) 310 stored in the HDD 306, and an application program 320 stored in the HDD 306 is executed on the OS 310. With the application program 320, an operator operates the operation unit 302 in the operation terminal 300 to thereby create printing data for printing on a printing label 200 to be created in the printing apparatus 1 and transmit the created printing data to the printing apparatus 1. That is, a predetermined label creation instruction including the printing data is outputted to the printing apparatus 1 by a user operation on the operation unit 302. Then, in the printing apparatus 1, the platen roller 25 and feed roller 101 are driven through the motor drive circuit 61 and the drive roller 66, and the printing tape 50 is drawn out from the printing tape roll 51. In synchronization with this, a plurality of heating elements of the thermal head 22 are selectively heated through the thermal head drive circuit 61, and printing based on the printing data is performed on the printing tape 50 delivered and conveyed. Thereafter, a winding part 90 (details thereof will be described later) and a label main body part 91 (details thereof will be described later) are manually peeled off from the printing tape 50 on which printing is formed, whereby a printing label 200 (see FIG. 6) having a predetermined printing is generated. The above peel-off may be performed as follows. That is, the printing tape 50 on which printing is formed is cut into a predetermined length by a cutter 29 (see FIG. 19) provided near the discharge port 20 of the main body part 11 and then discharged from the discharge port 20, and the winding part 90 and label main body part 91 are peeled off from the discharged printing tape 50 of the predetermined length. The cutter 29 for cutting the printing tape 50 is activated when an unillustrated cutter button is operated.

<Structure of Printing Tape and Example of Use of Printing Label>

Figure 5A:
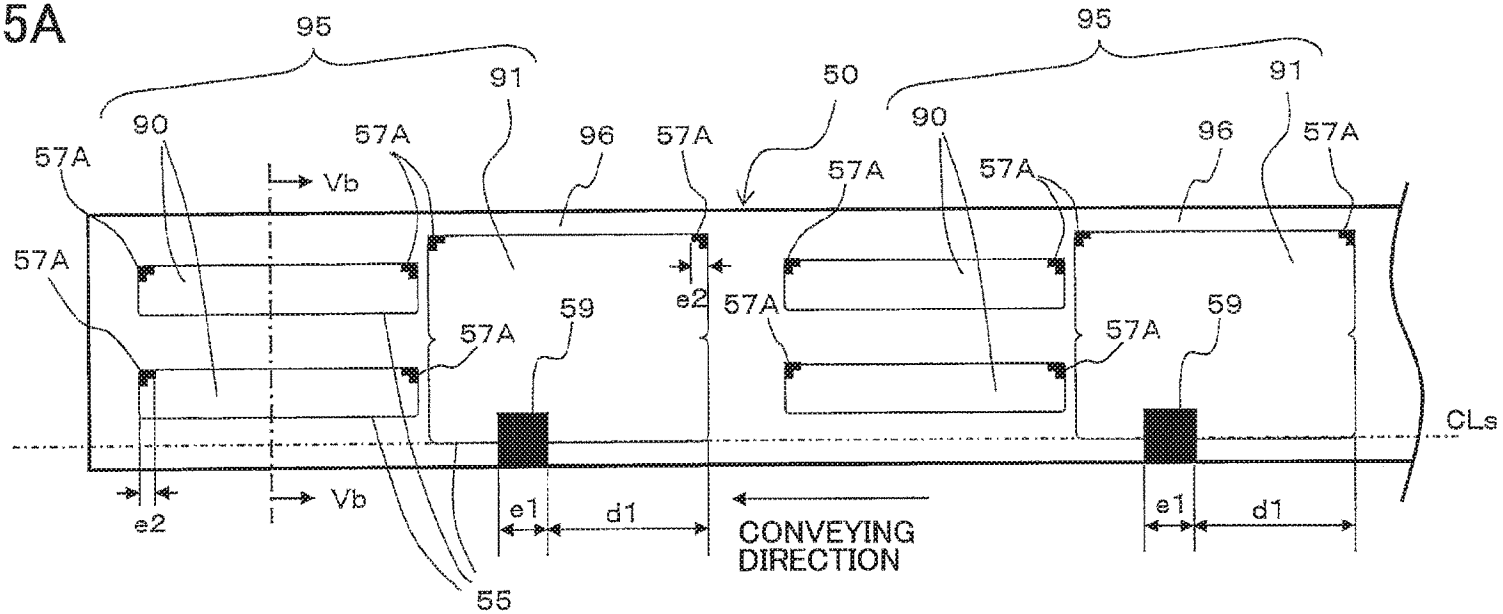
FIG. 5A is a plan view illustrating an exterior of a printing tape.
Figure 5B:
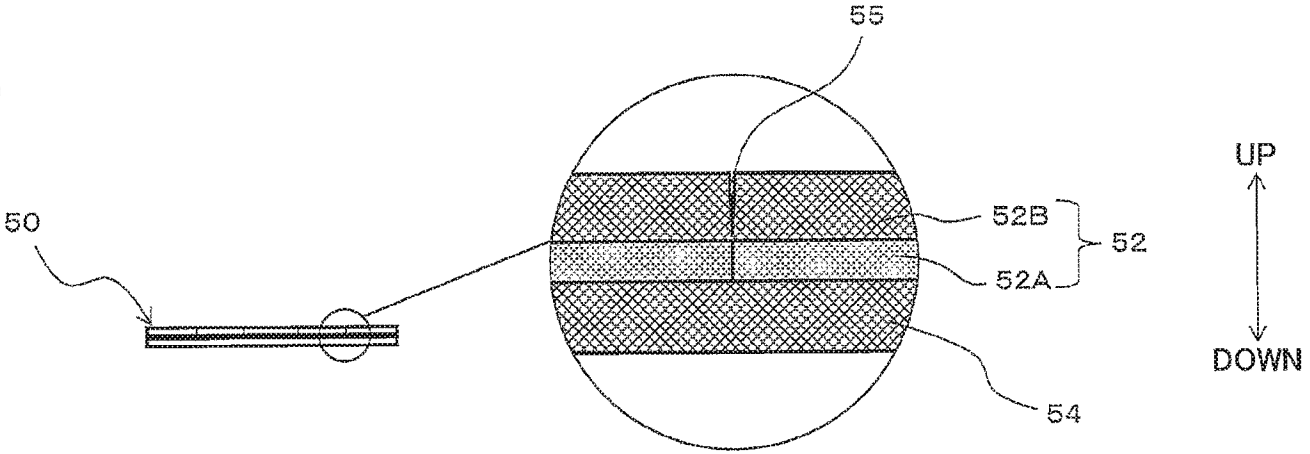
FIG. 5B is a transverse cross-sectional view taken along a line Vb-Vb of FIG. 5A.

The printing tape 50 used in the present embodiment is illustrated in FIGS. 5A and 5B. FIG. 5A is a plan view of the printing tape 50 on which neither a mark to be described later nor internal printing is formed. In FIG. 5A, the left-right direction is defined as the tape conveying direction. FIG. 5B is a cross-sectional view as viewed in the direction of arrow Vb-Vb in FIG. 5A.

As illustrated in a partially enlarged cross-sectional view of FIG. 5B, the printing tape 50 of this example includes a printing sheet 52 and a release sheet 54 which are laminated from the top in this order in the thickness direction. The printing sheet 52 includes a base material 52B provided on the upper side thereof (see the partially enlarged view of FIG. 5B in which the up-down direction is defined (the same applies hereinafter)), and printing is formed on the printing surface of the base material 52B by the thermal head 22. The printing sheet 52 further includes an adhesive layer 52A below the base material 52B. The release sheet 54 is easily peelably affixed to the adhesive layer 52A. In other words, the printing sheet 52 is peelably affixed to the upper surface (corresponding to a first surface) of the release sheet 54. The release sheet 54 corresponds to a first sheet described in the claims of the present disclosure, and the printing sheet 52 corresponds to a second sheet described in the claims of the present disclosure.

In the present embodiment, half-cutting operation is previously applied to the printing tape 50 so as to create a P-type label 92 (described later) or a T-type label 93 (described later). As illustrated in the partially enlarged cross-sectional view of FIG. 5B, the half-cutting operation is treatment of forming a cut line 55 in the printing sheet 52 of the printing tape 50, whereby a so-called die-cut label is obtained. The half-cutting operation is applied so as to surround a predetermined area as illustrated in the plan view of FIG. 5A, thus allowing the printing sheet 52 in this area to be freely peeled off from the printing tape 50. In the present embodiment, a part of the printing sheet 52 to be peeled off is referred to as "label portion 95", and the remaining part of the printing sheet 52 is referred to as "non-label portion 96".

The label portion 95 includes a winding part 90 (corresponding to a second label) and a label main body part 91 (corresponding to a first label). In the present embodiment, a plurality of sets each including two winding parts 90 and one label main body part 91 are previously formed along the length direction of the printing tape 50. The two winding parts 90 are each formed into a substantially rectangular shape elongated in the conveying direction (in other words, tape longitudinal direction (the same applies hereinafter)) and arranged parallel to each other in the widthwise direction of the printing tape 50. The one label main body part 91 formed into a substantially rectangular shape having a wide width is disposed upstream of the two winding parts 90 in the conveying direction. In the present embodiment, predetermined printing (see printings R1 and R2) is applied to the internal area of the label main body part 91 by the above-described printing apparatus 1.

A mark 57A and a sensor mark 59 in FIG. 5A will be described later using FIGS. 10 and 14.

<Use Forms as P-type label and T-shaped Label>

Figure 6A:
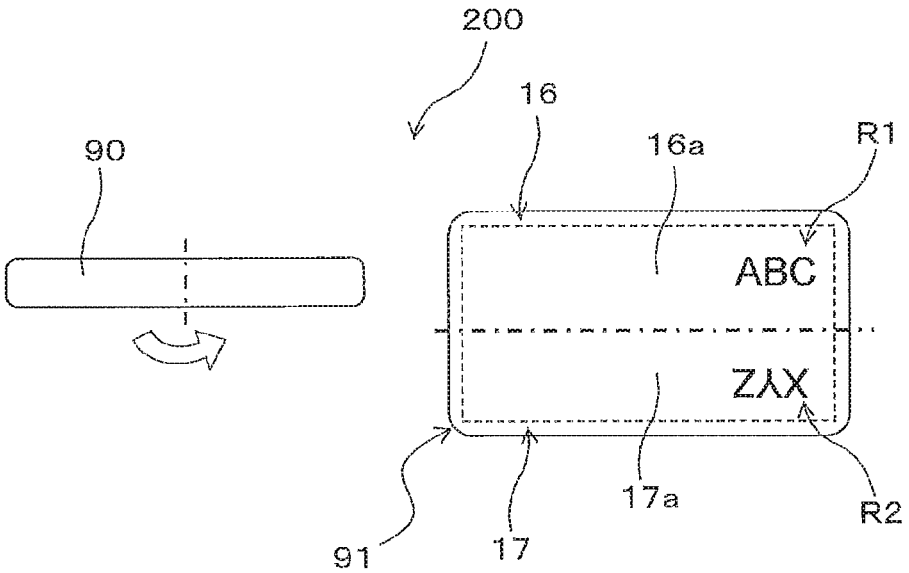
FIG. 6A is a plan view illustrating an exterior of a printed printing label.
Figure 6B:
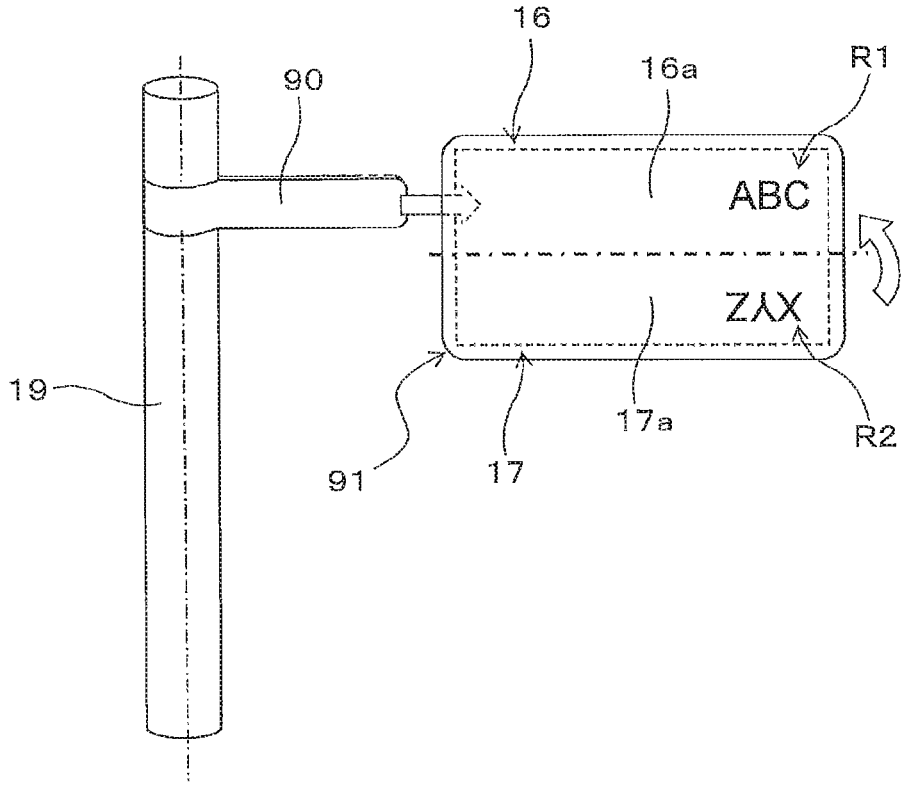
FIG. 6B is an explanatory diagram for explaining the printing label in a usage example where the printing label is used as a P type label.

FIGS. 6A, 6B, 7A, and 7B are views illustrating a case where the printing label 200 (winding part 90 and label main body part 91) peeled off from the printing tape 50 is used as the P-type label 92 (to be described later). In FIGS. 6A and 6B, the label main body part 91 has a first label area 16 and a second label area 17 which are connected to each other in the up-down direction in the drawing. The first and second label areas 16 and 17 have the same rectangular shape elongated in the left-right direction in the drawing. The first label area 16 has a first printing surface 16*a* on which a printing R1 is formed by the printing apparatus 1. The second label area 17 has a second printing surface 17*a* on which a printing R2 is formed by the printing apparatus 1. In the illustrated example, a character string "ABC" is printed in a right-aligned state at the center of the first printing surface 16*a* in the up-down direction as the printing R1, and a character string "XYZ" is printed in a 180-degree (inverted) attitude in the left-right direction with right justification at the center of the second printing surface 17*a* in the up-down direction as the printing R2.

When the label main body part 91 and winding part 90 are used, the printing label 200 illustrated in FIG. 6A is peeled off from the printing tape 50. Subsequently, as illustrated in FIG. 6B, the winding part 90 is wound around a circular tubular or cable-like adherend 19 (a cable in this example (hereinafter, the adherend 19 is referred to as "cable 19" according to the need)) having its axis direction in the up-down direction such that substantially the center of the winding part 90 in the left-right direction is affixed to the cable 19 and is then folded (see the white arrow in FIG. 6A). Thereafter, the back surfaces (adhesive layer 52A) of the both ends of the winding part 90 are affixed to each other.

Then, the boundary line (dashed dotted line in the drawing) between the first and second label areas 16 and 17 is mountain-folded to affix the back surfaces (adhesive layer 52A) of the first and second label areas 16 and 17 to each other. At this time, the leading ends (right end in the drawing) of the folded and affixed winding part 90 are inserted between one ends (left ends in the drawing) of the respective first and second label areas 16 and 17 in the longitudinal direction. As a result, the P-type label 92 is formed.

Figure 7A:
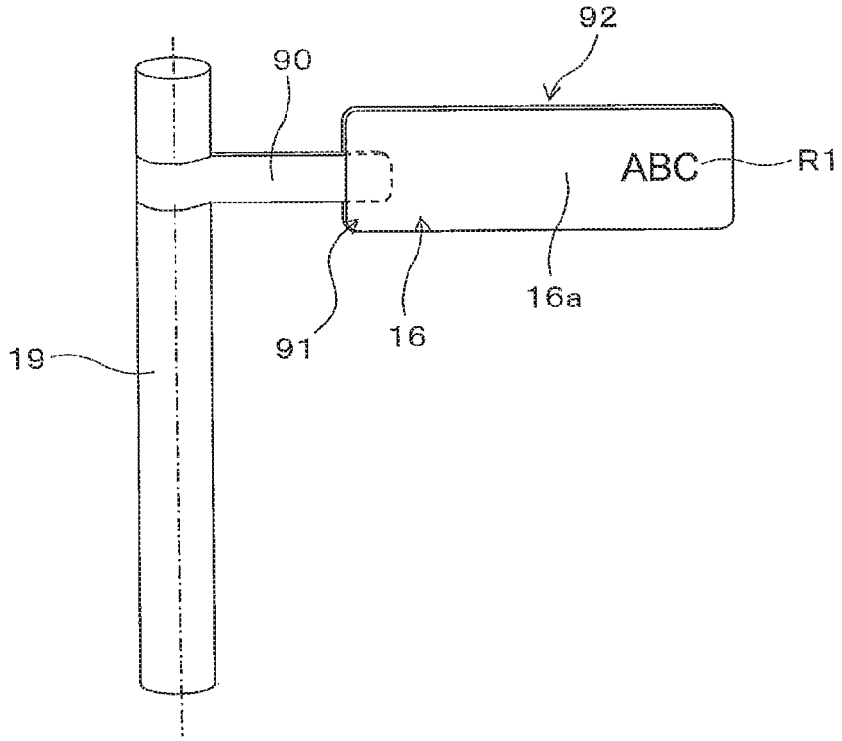
FIGS. 7A and 7B are explanatory diagrams for illustrating exterior of the P-type label in a usage example.
Figure 7B:
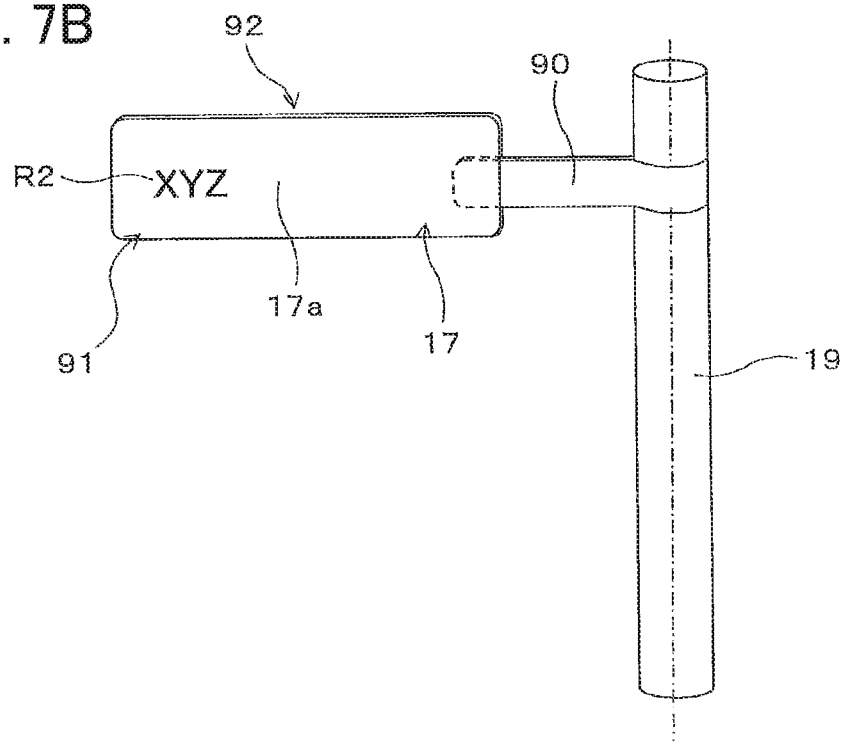

Thus, as illustrated in FIGS. 7A and 7B, the overlapped first and second label areas 16 and 17 protrude in the left-right direction from the winding part 90 affixed to the cable 19. That is, the entire shape including the cable 19 becomes a P-shape. FIG. 7A illustrates the outer appearance of the P-type label 92 affixed to the cable 19, as viewed from the front side (first label area 16 side). As illustrated, in the first label area 16, the character string "ABC" is printed on the first printing surface 16*a* as the printing R1 in an upright posture, aligned to an end portion (rear end of the character string "ABC") opposite to the winding part 90.

FIG. 7B illustrates the outer appearance of the P-type label 92 affixed to the cable 19 from the back side (second label area 17 side). As illustrated, in the second label area 17, the character string "XYZ" is printed on the second printing surface 17*a* as the printing R2 in an upright posture, aligned to an end portion (front end of the character string "XYZ") opposite to the winding part 90.

Figure 8A:
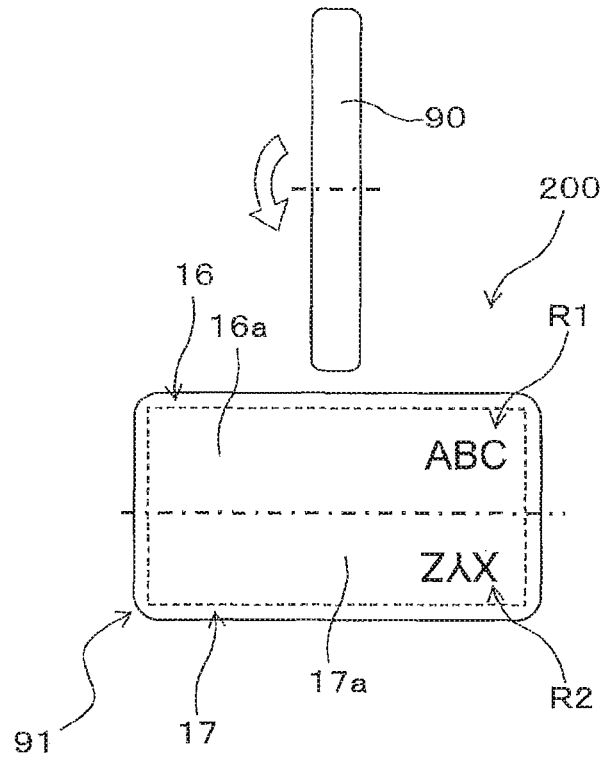
FIG. 8A is a plan view of an exterior of the printing label in use.
Figure 8B:
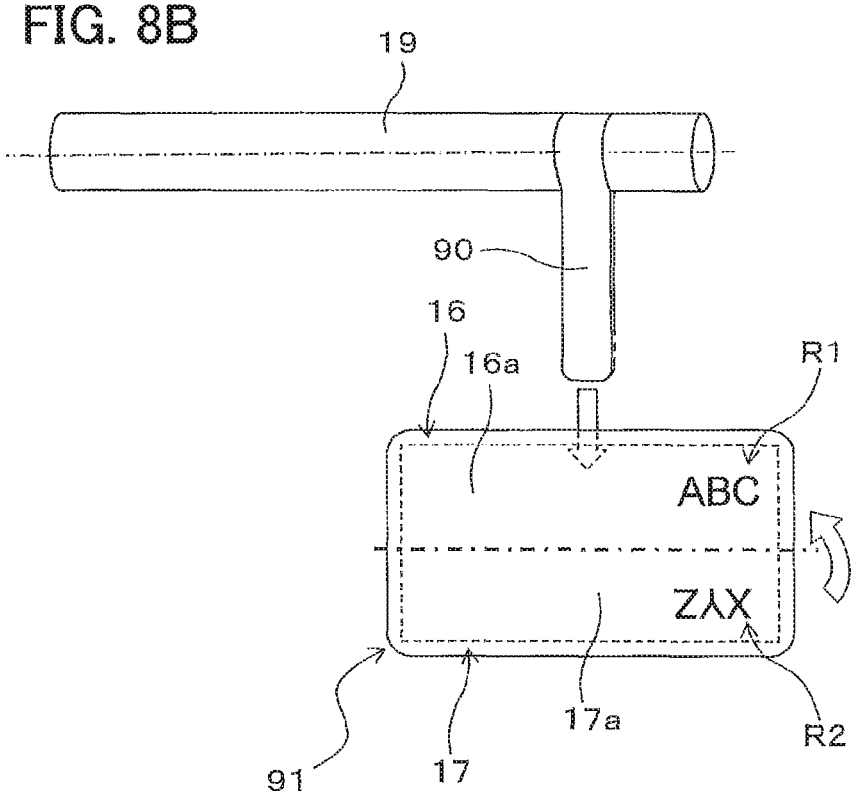
FIG. 8B is an explanatory diagram for explaining the printing label in a usage example where the printing label is used as a T type label.

Further, the above printing label 200 can be also used as a T-type label 93. FIGS. 8A, 8B, 9A, and 9B are views illustrating a case where the winding part 90 and the label main body part 91 peeled off from the printing tape 50 is used as the T-type label 93. In the case of the P-type label 92, the folded and affixed leading ends of the both ends of the winding part 90 that is wound around the cable 19 are inserted between one ends of the respective first and second label areas 16 and 17 in the longitudinal direction (see FIGS. 6A and 6B). On the other hand, in the case of the T-type label 93, as illustrated in FIGS. 8A and 8B, the folded and affixed leading ends of the both ends of the winding part 90 that is wound around the cable 19 are inserted between free-side ends (edge portions on both the upper and lower sides) of the respective first and second label areas 16 and 17 at the center of the longitudinal direction.

Figure 9A:
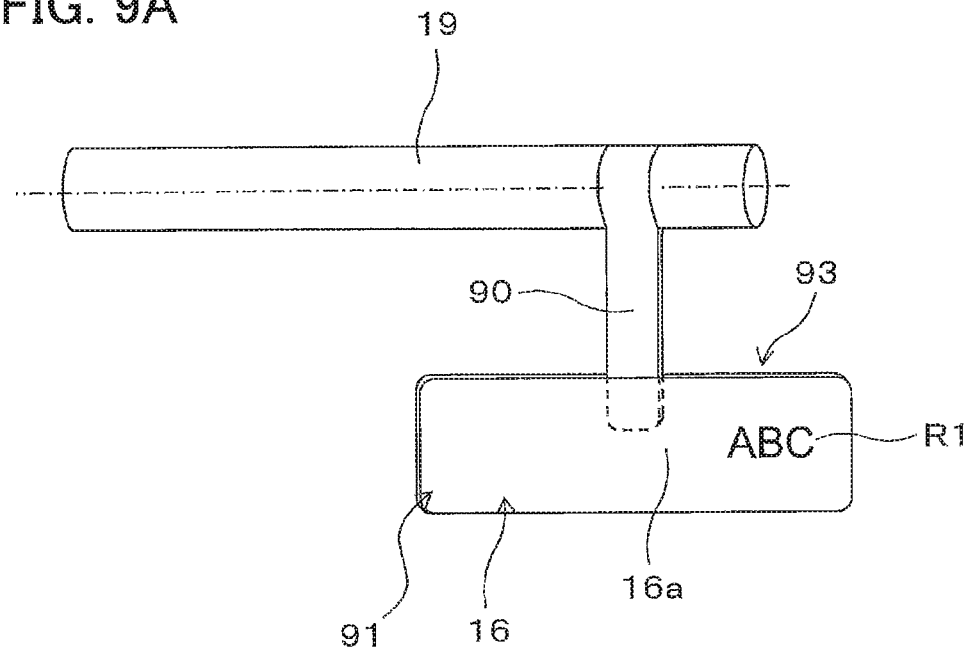
FIGS. 9A and 9B are explanatory diagrams for illustrating an exterior of the T type label in the usage example.
Figure 9B:
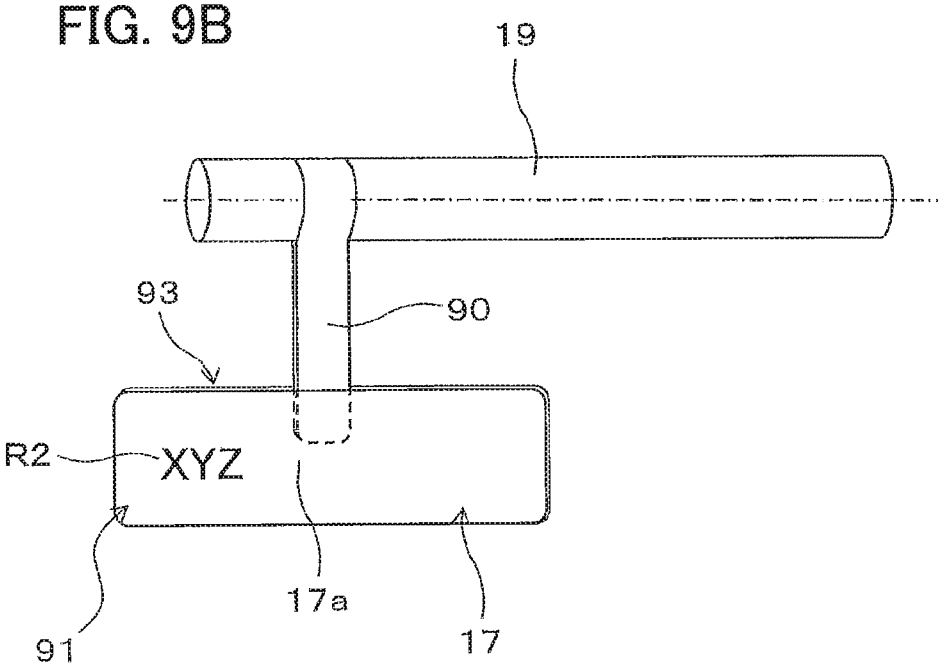

Thus, as illustrated in FIGS. 9A and 9B, the longitudinal direction of the overlapped first and second label areas 16 and 17 is parallel to the longitudinal direction of the cable 19. That is, the winding part 90 and label main body part 91 form a T-shape.

In both cases of the P-type label 92 and T-type label 93, it is sufficient to prepare one winding part 90 in the above use form. However, in the present embodiment, in order to make effective use of the widthwise direction of the printing tape 50, two winding parts 90 including one spare winding part 90 are formed together with the label main body part 91 as one set. The one spare winding part 90 may be used for purposes other than as a spare.

<Features of Present Embodiment>

As described above, the printing sheet 52 of the printing tape 50 is divided into the label portion 95 to be actually subjected to printing and non-label portion 96 by the cut line 55. At the time of use, only the label portion 95 is peeled off from the release sheet 54 with the non-label portion 96 left on the release sheet 54. At this time, the peel-off position of the label portion 95 on the printing sheet 52 may be hard to visually distinguish depending on the form of the cut line 55 or material of the printing sheet 52.

Thus, in the present embodiment, the printing sheet 52 and release sheet 54 are each formed of a translucent material. Further, marks are previously printed on the release sheet 54 near the position corresponding to the cut line 55 (including both the position overlapping the cut line 55 in a plan view and the position slightly apart therefrom). Hereinafter, details of the mark will be described.

<First Example of Mark>

For example, in the present embodiment, the printing sheet 52 and release sheet 54 are each formed of a resin material having translucency, such as PET (Polyethylene terephthalate) (the adhesive layer 52A of the printing sheet 52 also has translucency). Thus, the entire printing tape 50 transmits light in the thickness direction thereof.

In the above printing tape 50 of the present embodiment, marks are printed on the lower surface of the release sheet 54 in an arrangement that substantially corresponds to the cut line 55 of the printing sheet 52 formed by half-cutting operation.

Figure 10A:
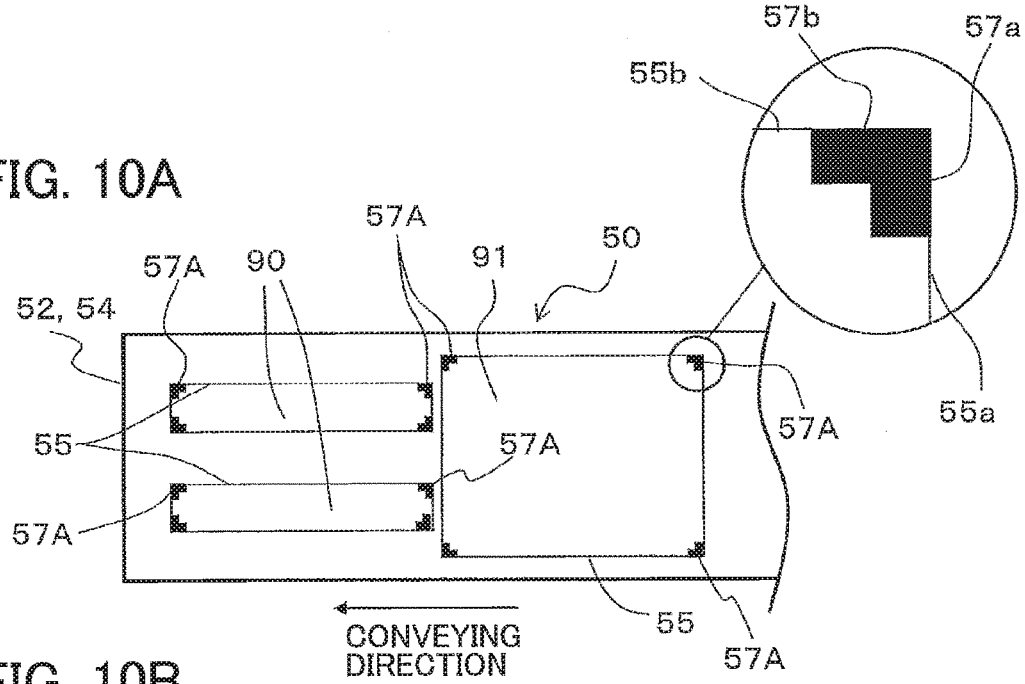
FIG. 10A is a schematic plan view illustrating a configuration of the printing tape in which a release sheet has a mark example printed thereon.
Figure 10B:
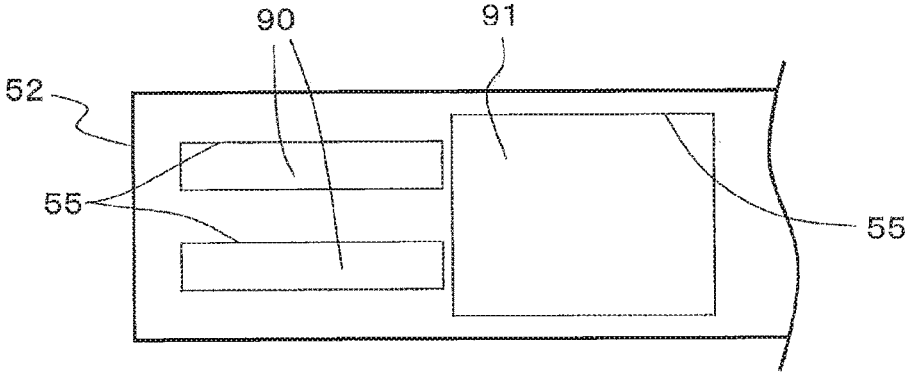
FIG. 10B is a schematic plan view illustrating a printing sheet extracted from the printing tape of FIG. 10A.
Figure 10C:
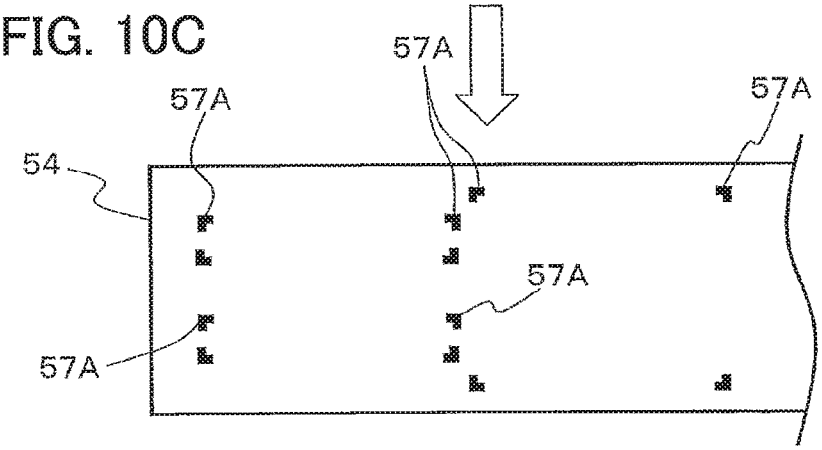
FIG. 10C is a schematic plan view illustrating the release sheet extracted from the printing tape of FIG. 10A.

FIG. 10A is a conceptual plan view representing the structure of the printing tape 50 in which the marks 57A are printed on the release sheet 54. FIG. 10B is a conceptual plan view illustrating only the printing sheet 52 of the printing tape 50 illustrated in FIG. 10A. FIG. 10C is a conceptual plan view illustrating only the release sheet 54 of the printing tape 50 illustrated in FIG. 10A. As described using FIG. 5A, the cut lines 55 of the printing sheet constituting the outlines of the respective winding part 90 and label main body part 91 are formed on the printing sheet 52 (see FIG. 10B). As illustrated in FIG. 10C, the marks 57A are printed on the lower surface (surface on the far side in the drawing, which corresponds to a second surface) of the release sheet 54 so as to correspond in shape and arrangement to the cut lines 55 as viewed from above (near side in the drawing). In this example, the marks 57A are printed within areas corresponding to the winding part 90 and label main body part 91 in a plan view.

The marks 57A are previously printed on the lower surface of the release sheet 54 at, e.g., the factory production stage of the printing tape 50. At this time, since the release sheet 54 is formed of a translucent material as described above, the marks 57A can be visually confirmed from above the release sheet 54 (from near side in the drawing) in a see-through manner as illustrated in FIG. 10C.

The printing tape 50 is formed by laminating the printing sheet 52 having the configuration illustrated in FIG. 10B on the release sheet 54 having the configuration illustrated in FIG. 10C (see the white arrow in the drawing). Since not only the release sheet 54, but also the printing sheet 52 is formed of a translucent material, the marks 57A can be visually confirmed even from above (from near side in the drawing) the printing tape 150 in a see-through manner as illustrated in FIG. 10A. As a result, the marks 57A are seen so as to overlap (or contact) the cut lines 55 formed on the upper surface (surface on the near side in the drawing) of the printing sheet 52. Thus, as described above, when peeling off the label portion 95 (winding part 90 and label main body part 91) from the printing sheet 52 at the time of use, a user can peel off the label portion 95 while visually confirming the marks 57A corresponding to the cut lines 55 through the translucent release sheet 54 and printing sheet 52.

Figure 14A:
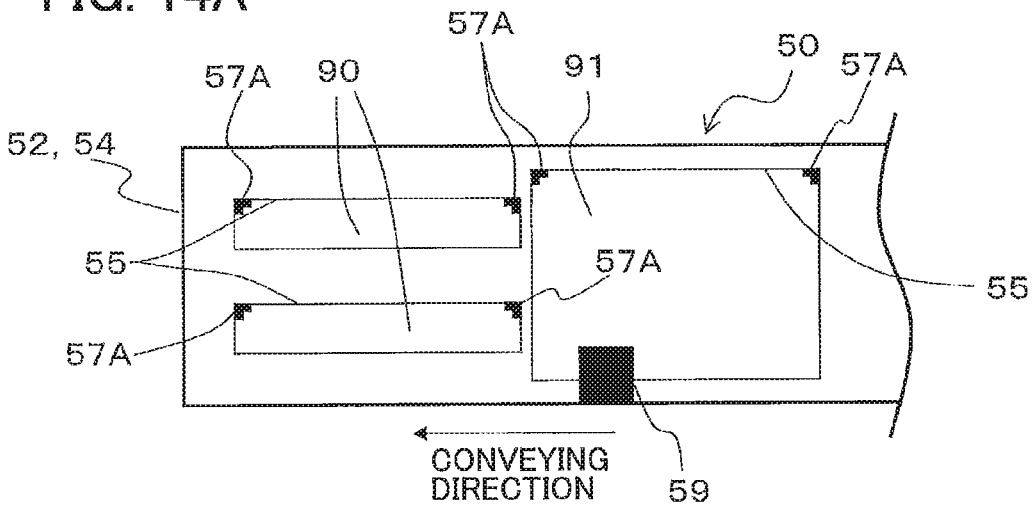
FIG. 14A is a schematic plan view illustrating a configuration of the printing tape in which the release sheet has another mark example printed thereon.
Figure 14B:
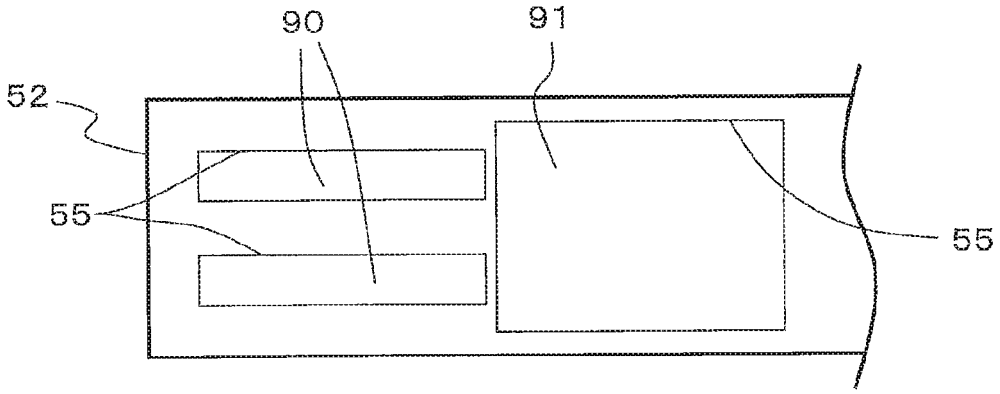
FIG. 14B is a schematic plan view illustrating the printing sheet extracted from the printing tape of FIG. 14A.
Figure 14C:
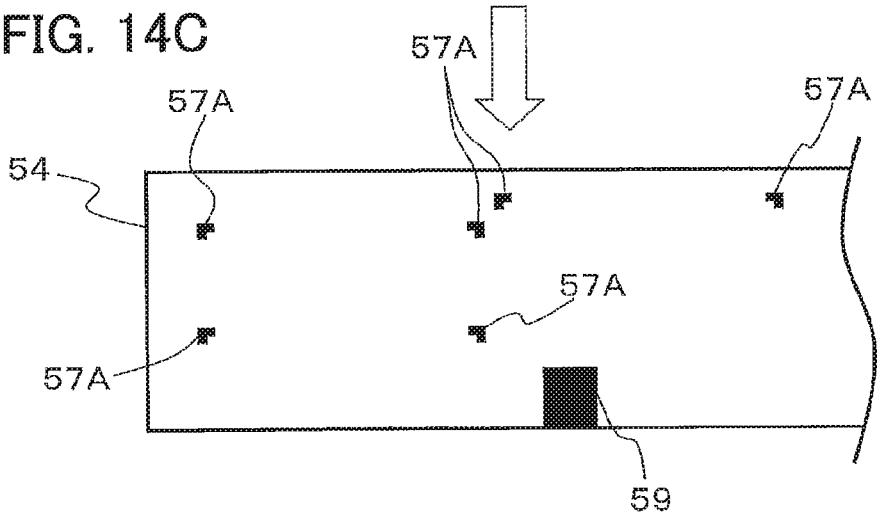
FIG. 14C is a schematic plan view illustrating the release sheet extracted from the printing tape of FIG. 14A.

It is sufficient for the marks 57A to be printed so as to roughly indicate the positions of the cut lines 55, so that, in this example, 12 marks 57A in total are printed in the illustrated range so as to indicate four corners of each of the rectangular label portions 95 (two winding parts 90 and one label main body part 91) when viewed in a see-through manner. While the four marks are printed for each label portion 95, the number of the marks to be printed for each label portion 95 may be two (as illustrated in FIGS. 14A and 14C) or three (in this case, arbitrary one mark is omitted from among the four marks).

The marks 57A each have a substantially L-shape (which resembles Japanese quotation mark) in this example. However, although not particularly illustrated, each mark 57A may have a square bracket shape ("[" or "]") or a bold black-lenticular bracket shape. The end portion of each mark 57A in the tape longitudinal direction (left-right direction in the drawing) is printed on the same position as the corresponding cut line 55. Specifically, as illustrated in the enlarged view of FIG. 10A, the mark 57A printed on the upper-right corner of the label main body part 91 has a first end part (end part 57*a* in the illustrated example) on one side in the tape longitudinal direction and a second end part (end part 57*b* in the illustrated example) on one side in the tape transverse direction. On the other hand, the label portion 95 (specifically, the label main body part 91 in the illustrated example) has a first side (side 55*a* in the illustrated example) extending in the tape transverse direction on one side in the tape longitudinal direction so as to be connected to the corner in the enlarged view. The label portion 95 further has a second side (side 55*b* in the illustrated example) extending in the tape longitudinal direction on one side in the tape transverse direction so as to be connected to the corner in the enlarged view. The first end part 57*a* of the mark 57A is printed at the same position (tape longitudinal direction position) as the side 55*a* in a plan view, and the second end part 57*b* of the mark 57A is printed at the same position (tape transverse direction position) as the side 55*b*. In other words, the mark 57A is printed such that the corner thereof coincides with the corner of the label portion 95 (specifically, the label main body part 91), that is, such that the corner thereof is printed on the same position as the corner of the label portion 95. While the above is an example of the mark 57A printed on the upper-right corner of the label main body part 91 illustrated in FIG. 10A, the other 11 marks 57A also have the same positional relationship with the corner and side of the corresponding label portion 95 (winding part 90 or label main body part 91).

<Second Example of Mark>

Figure 11A:
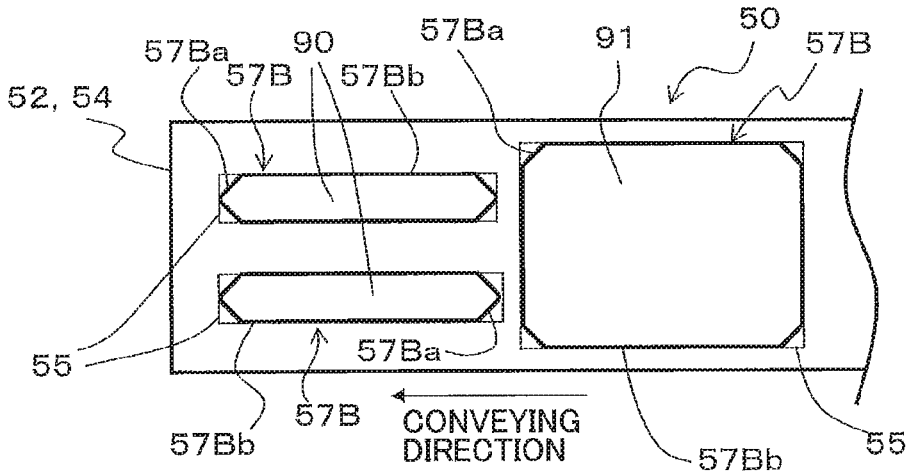
FIG. 11A is a schematic plan view illustrating a configuration of the printing tape in which the release sheet has another mark example printed thereon.
Figure 11B:
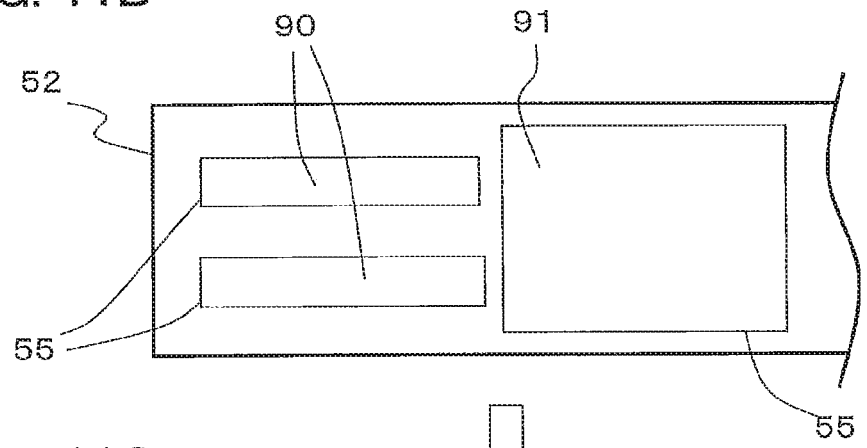
FIG. 11B is a schematic plan view illustrating the printing sheet extracted from the printing tape of FIG. 11A.
Figure 11C:
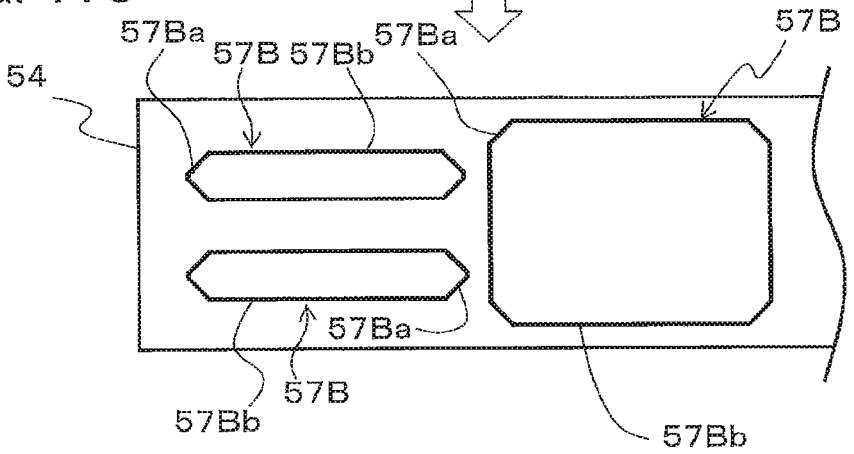
FIG. 11C is a schematic plan view illustrating the release sheet extracted from the printing tape of FIG. 11A.

FIGS. 11A to 11C illustrate another example of the mark. In this example, marks 57B are printed on the lower surface of the release sheet 54 as in the first example. Like FIGS. 10A to 10C; FIG. 11A is a conceptual plan view illustrating the structure of the printing tape 50 in which the marks 57B are printed on the release sheet 54; FIG. 11B is a conceptual plan view illustrating only the printing sheet 52 of the printing tape 50 illustrated in FIG. 11A; and FIG. 11C is a conceptual plan view illustrating only the release sheet 54 of the printing tape 50 illustrated in FIG. 11A.

As described using FIGS. 10A to 10C, the rectangular cut lines 55 constituting the outlines of the respective winding part 90 and label main body part 91 are formed on the printing sheet 52 (see FIG. 11B). In this example, as illustrated in FIG. 11C, each mark 57B is printed on the lower surface of the release sheet 54 so as to include a straight side part 57B*b* coinciding with a large part of each side constituting the rectangular cut line 55 in a plan view and an oblique side 57Ba that chamfers each corner of the rectangular cut line 55. Also in this example, the marks 57B are printed within areas corresponding to the winding part 90 and label main body part 91 in a plan view and are printed at the factory production stage of the printing tape 50 as in the first example. As in the first example, the printing tape 50 is formed by laminating the printing sheet 52 having the configuration illustrated in FIG. 11B on the release sheet 54 having the configuration illustrated in FIG. 11C (see the white arrow in the drawing).

In this example, when peeling off the label portion 95 (winding part 90 and label main body part 91) from the printing sheet 52 at the time of use, a user can peel off the winding part 90 and label main body part 91 starting from the corner of the rectangle while visually confirming the oblique side 57B*a* of the mark 57B roughly indicative of the position of the corner of the rectangular outline of each of the winding part 90 and label main body part 91 through the translucent release sheet 54 and printing sheet 52.

<Third Example of Mark>

Figure 12A:
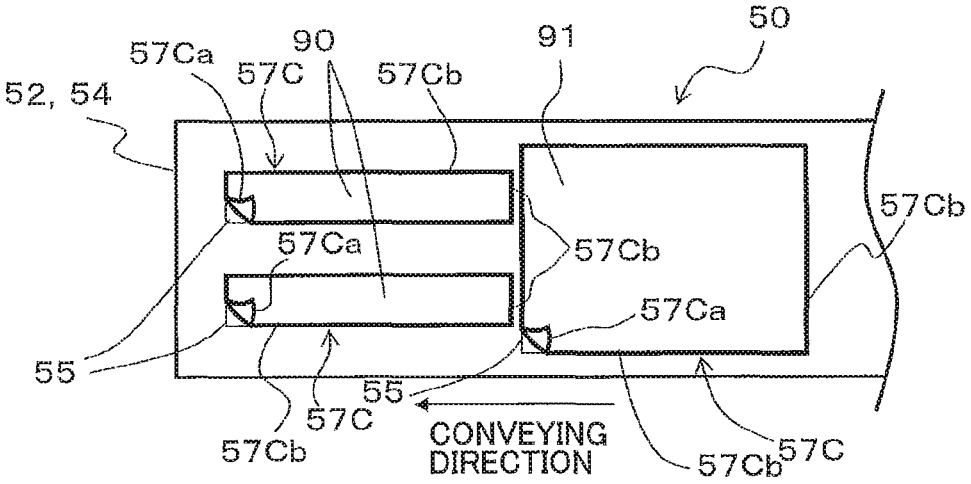
FIG. 12A is a schematic plan view illustrating a configuration of the printing tape in which the release sheet has another mark example printed thereon.
Figure 12B:
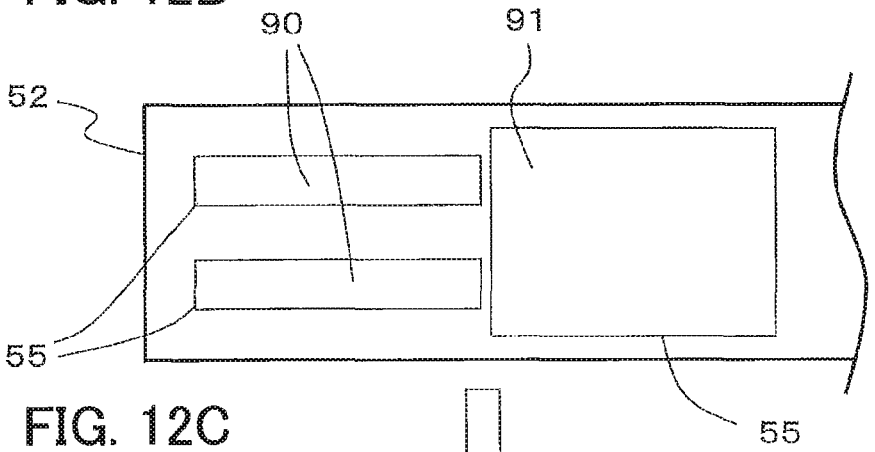
FIG. 12B is a schematic plan view illustrating the printing sheet extracted from the printing tape of FIG. 12A.
Figure 12C:
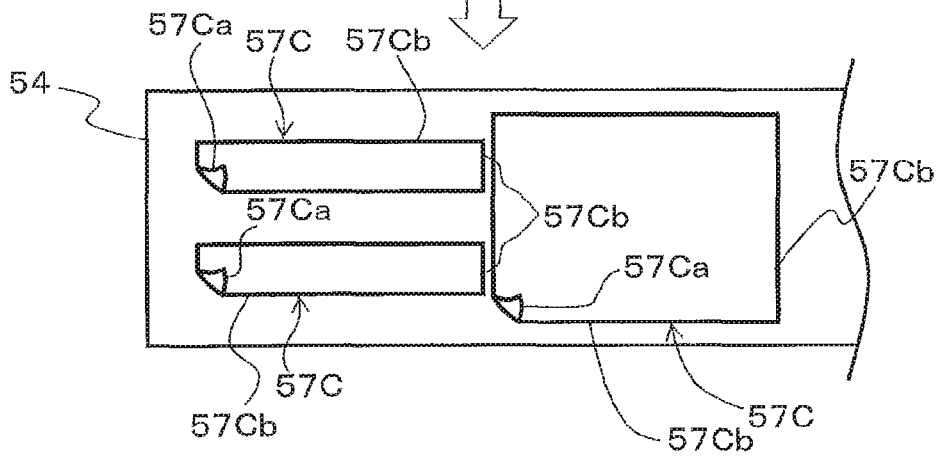
FIG. 12C is a schematic plan view illustrating the release sheet extracted from the printing tape of FIG. 12A.

FIGS. 12A to 12C illustrate still another example of the mark. In this example, marks 57C are printed on the lower surface of the release sheet 54 as in the above examples. Like FIGS. 10A to 10C and FIGS. 11A to 11C, FIG. 12A is a conceptual plan view illustrating the structure of the printing tape 50 in which the marks 57C are printed on the release sheet 54, FIG. 12B is a conceptual plan view illustrating only the printing sheet 52 of the printing tape 50 illustrated in FIG. 12A, and FIG. 12C is a conceptual plan view illustrating only the release sheet 54 of the printing tape 50 illustrated in FIG. 12A.

As described using FIGS. 10A to 10C, the rectangular cut lines 55 constituting the outlines of the respective winding part 90 and label main body part 91 are formed on the printing sheet 52 (see FIG. 12B). In this example, as illustrated in FIG. 12C, each mark 57C is printed on the lower surface of the release sheet 54 so as to include a straight side part 57C*b* coinciding with a large part of each side constituting the rectangular cut line 55 in a plan view and a turning-over part 57C*a* having a shape like a curled corner (representing turning-over of one of the four corners of each rectangle). Also in this example, the marks 57C are printed within areas corresponding to the winding part 90 and the label main body part 91 in a plan view and are printed at the factory production stage of the printing tape 50 as in the above examples. As in the above examples, the printing tape 50 is formed by laminating the printing sheet 52 having the configuration illustrated in FIG. 12B on the release sheet 54 having the configuration illustrated in FIG. 12C (see the white arrow in the drawing).

In this example, when peeling off the label portion 95 (winding part 90 and label main body part 91) from the printing sheet 52 at the time of use, a user can peel off the winding part 90 and the label main body part 91 starting from the corner of the rectangle while visually confirming the turning-over part 57C*a* of the mark 57C roughly corresponding to the position of the corner of the rectangular outline of each of the winding part 90 and label main body part 91 through the translucent release sheet 54 and the printing sheet 52.

<Fourth Example of Mark>

Figure 13A:
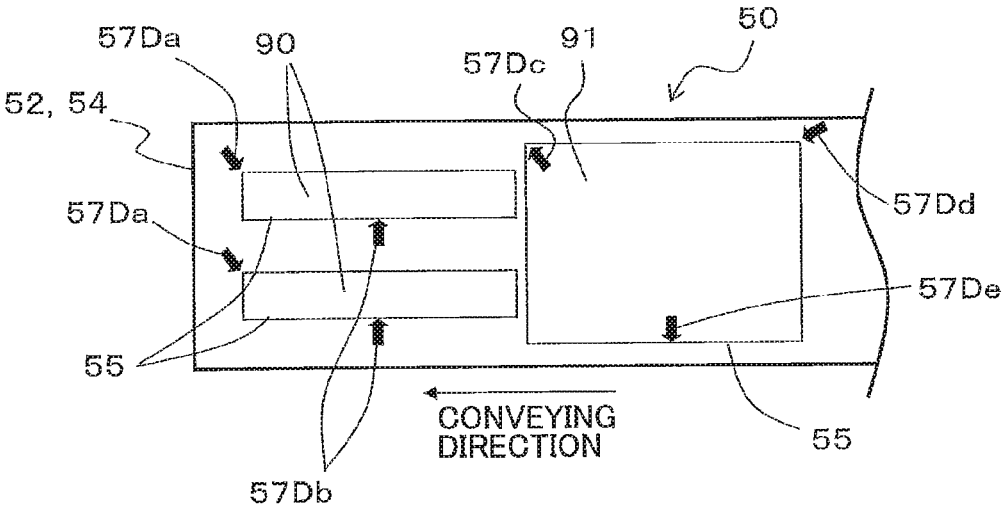
FIG. 13A is a schematic plan view illustrating a configuration of the printing tape in which the release sheet has another mark example printed thereon.
Figure 13B:
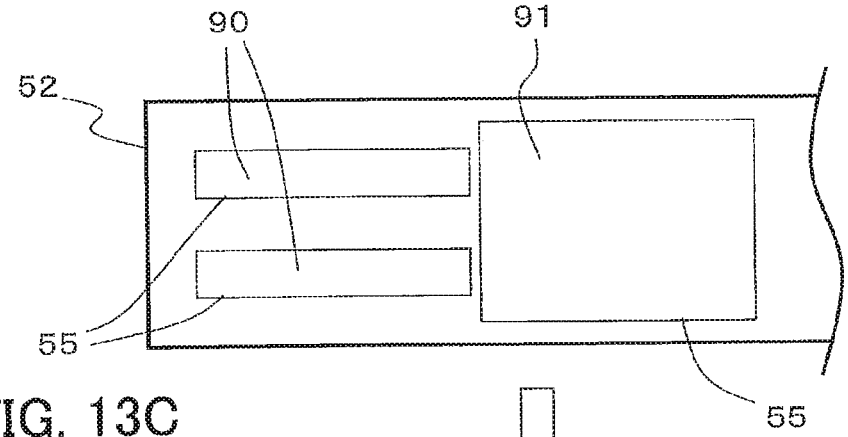
FIG. 13B is a schematic plan view illustrating the printing sheet extracted from the printing tape of FIG. 13A.
Figure 13C:
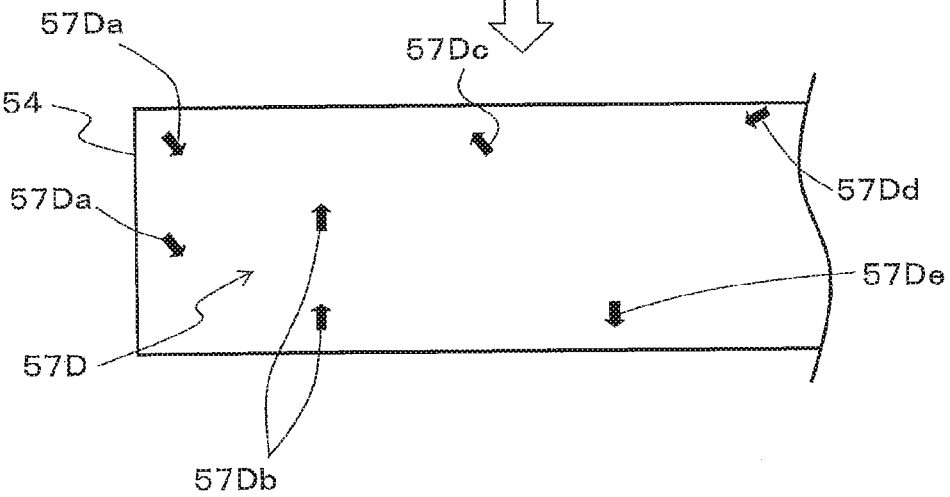
FIG. 13C is a schematic plan view illustrating the release sheet extracted from the printing tape of FIG. 13A.

FIGS. 13A to 13C illustrate still another example of the mark. In this example, marks 57D are printed on the lower surface of the release sheet 54 as in the above examples. Like FIGS. 10A to 10C, FIG. 13A is a conceptual plan view illustrating the structure of the printing tape 50 in which the marks 57D are printed on the release sheet 54, FIG. 13B is a conceptual plan view illustrating only the printing sheet 52 of the printing tape 50 illustrated in FIG. 13A, and FIG. 13C is a conceptual plan view illustrating only the release sheet 54 of the printing tape 50 illustrated in FIG. 13A.

As described using FIGS. 10A to 10C, the rectangular cut lines 55 constituting the outlines of the respective winding part 90 and label main body part 91 are formed on the printing sheet 52 (see FIG. 13B). As in the above examples, the marks 57D are printed on the lower surface of the release sheet 54 (e.g., at the factory production stage of the printing tape 50). As illustrated in FIG. 13C, the marks 57D include arrows 57D*a* and 57D*b* for each of the two winding parts 90 and include arrows 57D*c*, 57D*d*, and 57D*e* for one label main body part 91. The arrow 57D*a* indicates one of the four corners of the rectangle at the outside of the area corresponding to the winding part 90. The arrow 57D*b* indicates one of the four sides of the rectangle at the outside of the area corresponding to the winding part 90. The arrow 57D*c* indicates one of the four corners of the rectangle at the inside of the area corresponding to the label main body part 91. The arrow 57D*d* indicates one of the four corners that is different from the corner indicated by the arrow 57D*c* at the outside of the area corresponding to the label main body part 91. The arrow 57D*e* indicates one of the four sides of the rectangle at the outside of the area corresponding to the label main body part 91. As in the above examples, the printing tape 50 is formed by laminating the printing sheet 52 on the release sheet 54, where the printing sheet 52 has the configuration illustrated in FIG. 13B and the release sheet 54 has the configuration illustrated in FIG. 13C (see the white arrow in the drawing).

In this example, when peeling off the label portion 95 (winding part 90 and label main body part 91) from the printing sheet 52 at the time of use, a user can peel off the winding part 90 and the label main body part 91 starting from the corner or side of the rectangle while visually confirming the arrows 57D*a*, 57D*c*, or 57D*d* and the arrows 57D*b* or 57D*e*. Here, the arrows 57D*a*, 57D*c*, or 57D*d* corresponds to the position of the corner of the rectangular outline of each of the winding part 90 and label main body part 91, and the arrows 57D*b* or 57D*e* corresponds to position of the side of the rectangle through the translucent release sheet 54 and the printing sheet 52.

<Fifth Example of Mark (case where marks are printed together with sensor mark)>

In this example, the sensor mark 59 for positioning control at the time of the conveyance of the printing tape 50 is previously printed on the lower surface of the release sheet 54 on which the marks 57 are printed. That is, as illustrated in FIGS. 14A to 14C, the marks 57A each having substantially an L-shape (which resembles Japanese quotation mark) that are the same as those illustrated in FIGS. 10A and 10C are printed on the lower surface of the release sheet 54. Like FIGS. 10A to 10C, FIG. 14A is a schematic plan view illustrating the structure of the printing tape 50 in which the marks 57A are printed on the release sheet 54; FIG. 14B is a conceptual plan view illustrating only the printing sheet 52 of the printing tape 50 illustrated in FIG. 14A; and FIG. 14C is a conceptual plan view illustrating only the release sheet 54 of the printing tape 50 illustrated in FIG. 14A.

As illustrated in FIGS. 10A to 10C, the rectangular cut lines 55 constituting the outlines of the respective winding part 90 and label main body part 91 are formed on the printing sheet 52 (see FIG. 14B). As illustrated in FIG. 14C, unlike the example of FIG. 10C, the marks 57A are printed on the lower surface of the release sheet 54 so as to correspond only to the two corners of the four corners of the rectangular label portion 95 (two winding part 90 and one label main body part 91) on one side in the tape widthwise direction (i.e., upper side in the drawing) and are not printed at positions corresponding to the two corners on the other side in the tape widthwise direction (i.e., lower side in the drawing). That is, 6 marks 57A in total are printed in the illustrated range. As in the above examples, the printing tape 50 is formed by laminating the printing sheet 52 having the configuration illustrated in FIG. 14B on the release sheet 54 having the configuration illustrated in FIG. 14C (see the white arrow in the drawing).

Figure 15:
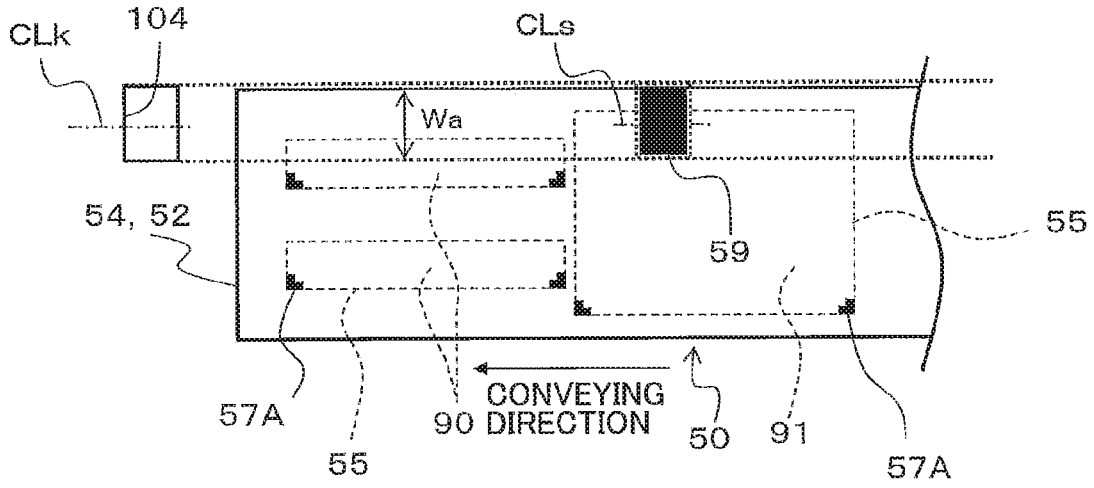
FIG. 15 is a schematic explanatory diagram illustrating the printing tape of FIG. 14A, which is viewed from the release sheet.

As illustrated in FIG. 3, the printing tape 50 having the above configuration is conveyed to pass through the through hole 104 formed in a side wall part 121 (see FIG. 3) of the casing 120 of the tape cartridge 100 with the release sheet facing the through hole 104. That is, as illustrated in FIGS. 14A and 14C and FIG. 15 which is a conceptual explanation view as viewed from the release sheet 54 side, the through hole 104 is formed in the side wall part 121 so as to face the movement path of the sensor mark 59 at the time of the conveyance of the printing tape 50.

The sensor marks 59 are previously printed at predetermined intervals on the release sheet 54 of the printing tape 50 within a widthwise direction area Wa that passes through the through hole 104 in a facing manner with the conveyance of the printing tape 50. The sensor mark 59 is a black solid mark having substantially the same shape and size (in other words, different in shape from each mark 57). In FIG. 3, to make clear the positional relationship between the through hole 104 and the sensor marks 59, the position of one sensor mark 59 is conceptually shown by the hatched area. In the printing apparatus 1, the optical sensor 65 (see FIG. 4) optically detects the sensor mark 59 through the through hole 104, and the CPU 82 sequentially detects the positions of the label main body parts 91 being conveyed on the basis of detection results from the optical sensor 65, whereby positioning control of the printing tape 50 at the time of the conveyance thereof is achieved (detailed control contents are omitted here).

FIG. 5A illustrates, of the printing tapes illustrated in FIGS. 10A, 11A, 12A, 13A and 14A, the printing tape 50 of the example illustrated in FIG. 14A. As illustrated in FIG. 5A, assuming that the distance between the end portion of the label main body part 91 on one side (right side in the drawing) in the tape longitudinal direction and the end portion of the sensor mark 59 on the same side in the tape longitudinal direction is d1, the distance d1 is the same between the label main body parts 91 arranged in the tape longitudinal direction of the printing tape 50. In other words, taking the illustrated two label main body parts 91 and 91 as an example, the distance (=d1) between the end portion of the left-side label main body part 91 (corresponding to a first label portion) on one side in the tape longitudinal direction and the end portion of the corresponding sensor mark 59 (corresponding to a first sensor mark) on the same side in the tape longitudinal direction and the distance (=d1) between the end portion of the right-side label main body part 91 (corresponding to a second label portion) on one side in the tape longitudinal direction and the end portion of the corresponding sensor mark 59 (corresponding to a second sensor mark) on the same side in the tape longitudinal direction are equal to each other. A length e1 of each sensor mark 59 in the tape longitudinal direction is larger than a length e2 of each mark 57A in the tape longitudinal direction.

The marks 57A are disposed so as not to overlap a tape widthwise direction center CLs of the sensor mark 59 in the tape longitudinal direction. Particularly, in this example, the marks 57A are disposed so as not to overlap the entire area of the sensor mark 59 in the tape longitudinal direction (see FIGS. 5 and 15). In other words, also based on the above-described positional relationship between the sensor mark 59 and through hole 104 facing each other, the marks 57A are disposed so as not to overlap a tape widthwise direction center CLk of the through hole 104 in the tape longitudinal direction. Particularly, in this example, the marks 57A are disposed so as not to overlap the entire area of the through hole 104 in the tape longitudinal direction (see FIG. 15).

This has the following significance. That is, when any mark 57A is printed within the widthwise direction area Wa of the sensor mark 59 (that is, within the widthwise direction area of the printing tape 50 that passes through the through hole 104 in a facing manner), the optical sensor 65 may erroneously detect the mark 57A as the sensor mark 59. Thus, the marks 57A are printed so as not be disposed within the widthwise direction area Wa of the sensor mark 59 as illustrated in FIG. 15, whereby the erroneous detection can be avoided.

The upper-side winding part 90 of the upper and lower winding parts 90 illustrated in FIG. 15 falls outside the widthwise direction area Wa of the sensor mark 59, so that the problem of erroneous detection does not occur even when the mark 57A is printed at positions corresponding to all the four corners of the rectangle. However, in this example, regarding its appearance, the mark 57A is printed only at the positions corresponding to the two corners as in the lower winding part 90.

<Effects of First Embodiment>

As described above, in the first embodiment, the release sheet 54 and printing sheet 52 are each formed of a translucent material, and marks 57A, marks 57B, marks 57C, marks 57D*a*, or marks 57D*b* (hereinafter, referred to collectively as "marks 57") are previously printed on the lower surface of the release sheet 54 at positions near the cut lines 55. Thus, a user can peel off the label portion 95 from the release sheet 54 while visually confirming the marks 57 corresponding to the positions of the cut lines 55 through the translucent release sheet 54 and printing sheet 52. As a result, the label portion 95 can be easily peeled off, thus enhancing user convenience.

Further, in the present embodiment, the label portion 95 has a rectangular shape, and the marks 57A, 57B, 57C, and 57D*a* each indicate the corner of the label portion 95. This allows the rectangular label portion 95 to be easily peeled off starting from the corner.

Particularly in the present embodiment, the marks 57A, 57B, 57C, and 57D*a* are each positioned at the corner of the label portion 95. This allows the position of the corner of the label portion 95 to be clearly indicated.

Particularly, in the present embodiment, the marks 57A have an L-shape (which resembles Japanese quotation mark). This allows the corner position of the label portion 95, the shape thereof, and direction thereof to be clearly indicated.

Particularly, in the present embodiment, two or more marks 57 are printed for each label portion 95. This allows a user to roughly grasp the size of the label portion 95, thus enabling reliable peeling-off.

Particularly, in the present embodiment, the label portion 95 has a rectangular shape, and the marks 57D*b* each indicate the side of the label portion 95. This allows the substantially rectangular label portion 95 to be easily peeled off starting from the side.

Particularly, in the present embodiment, the marks 57A, marks 57B, and marks 57C are printed within an area corresponding to the label portion 95. This allows the area of the label portion 95 to be clearly indicated, thus enabling reliable peeling-off.

Particularly, in the present embodiment, the sensor mark 59 for optical detection is printed on the release sheet 54 (see FIGS. 5 and 14), and the printing apparatus 1 detects the presence/absence of the sensor mark 59 using the optical sensor 65. Thus, a conveying state of the printing tape 50 or the position of the label portion 95 being conveyed can be grasped.

Particularly, in the present embodiment, the marks 57A are printed so as not to overlap the tape widthwise direction center CLs of the sensor mark 59 in the tape longitudinal direction. Further, the marks 57A are printed so as not to overlap the tape widthwise direction center CLk of the through hole 104 in the tape longitudinal direction. This can prevent the optical sensor 65 from erroneously detecting the mark 57A as the sensor mark 59 as described above, whereby detection accuracy can be improved.

Particularly, in the present embodiment, the marks 57A are printed so as not to overlap the entire sensor mark 59 in the tape longitudinal direction. Further, the marks 57A are printed so as not to overlap the entire through hole 104 in the tape longitudinal direction. This can prevent the erroneous detection of the optical sensor 65 most reliably.

Particularly, in the present embodiment, the sensor mark 59 differs in shape from each mark 57. This also can improve detection accuracy of the optical sensor 65.

Particularly, in the present embodiment, the marks 57D are each an arrow indicative of the corner or side of the winding part 90 or label main part 91. This allows the position of the indicated target (corner or side) to be made clear.

Next, a second embodiment of the present disclosure will be described with reference to FIGS. 16A to 18C. In the second embodiment, the same reference numerals are given to the same parts as in the first embodiment, and a detailed description thereof will be omitted or simplified as needed.

In the present embodiment, the mark is previously printed near the positions (including both the position overlapping the cut lines 55 and the position slightly apart from the overlapping position) corresponding to the cut lines 55 on the printing sheet 52. The details of the mark in the present embodiment will be described hereinafter.

<Sixth Example of Mark>

In the present embodiment, the mark is printed on the upper surface of the printing sheet 52 at positions near the cut lines 55 formed by the half-cutting operation.

Figure 16A:
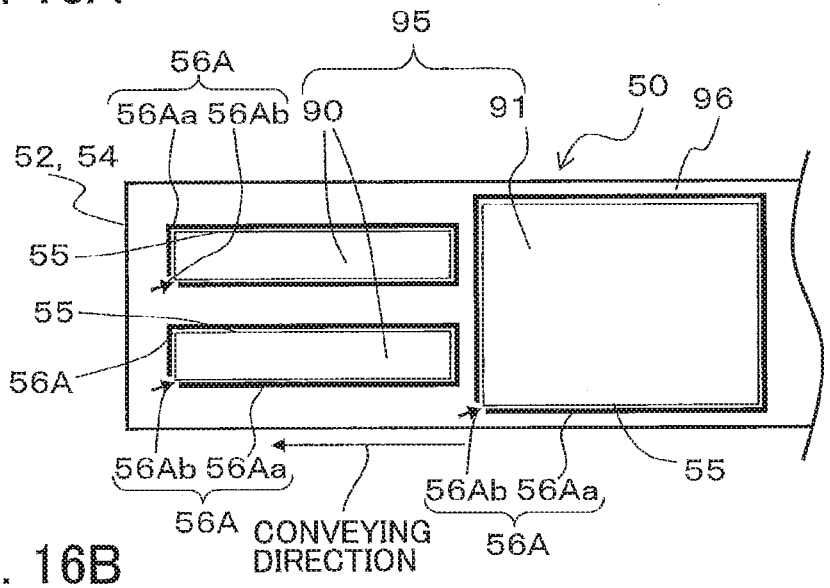
FIG. 16A is a schematic plan view illustrating a configuration of a printing tape in which a release sheet has a mark example printed thereon according to a second embodiment of the present disclosure.
Figure 16B:
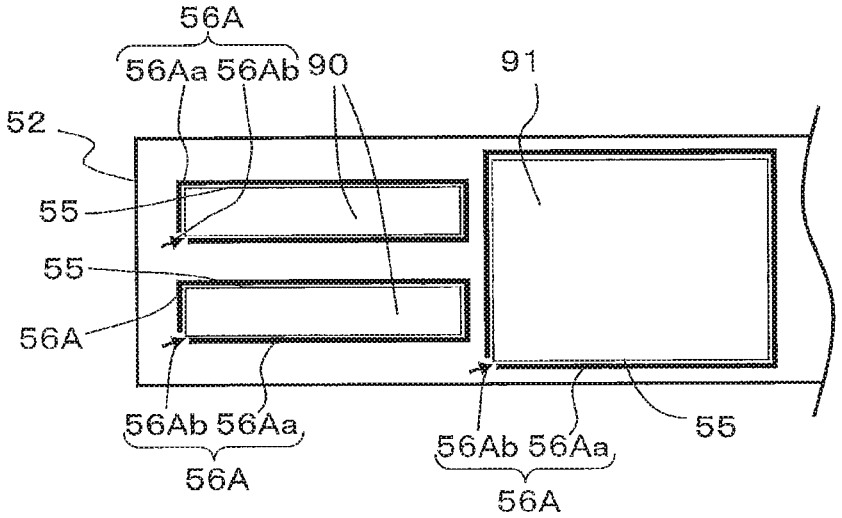
FIG. 16B is a schematic plan view illustrating a printing sheet extracted from the printing tape of FIG. 16A.
Figure 16C:
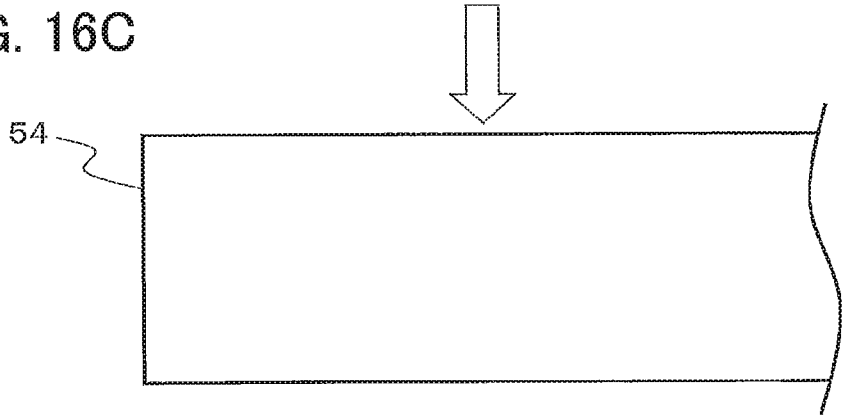
FIG. 16C is a schematic plan view illustrating the release sheet extracted from the printing tape of FIG. 16A.

FIG. 16A is a conceptual plan view illustrating the structure of the printing tape 50 in which marks 56A are printed on the printing sheet 52, FIG. 16B is a conceptual plan view illustrating only the printing sheet 52 of the printing tape 50 illustrated in FIG. 16A, and FIG. 16C is a conceptual plan view illustrating only the release sheet 54 of the printing tape 50 illustrated in FIG. 16A. As described above using FIG. 5A, the cut lines 55 constituting the outlines of the respective winding part 90 and label main body part 91 are formed on the printing sheet 52 (see FIG. 16B). Further, the marks 56A are printed on the upper surface (surface on the near side in the drawing) in a shape and arrangement that substantially surround the outer periphery of the rectangular cut line 55. In this example, marks 56A are printed outside the winding part 90 and label main body part 91.

The marks 56A are previously printed on the upper surface of the printing sheet 52 at, e.g., the factory production stage of the printing tape 50. At this time, the marks 56A are printed outside the label portion 95 (specifically, the label main body part 91), i.e., the non-label portion 96 so as not to affect printing operation of the printing apparatus 1 on the label portion 95 (specifically, the label main body part 91) on which no printing has been formed. That is, each mark 56A is printed on the upper surface of the printing sheet 52 (specifically, the non-label portion 96) so as to include a surrounding part 56A*a* that surrounds (in other words, borders the outer periphery at a position slightly apart therefrom) the most part of the outer periphery of the rectangular cut line 55 excluding one corner thereof and an arrow part 56A*b* that indicates the one corner (at a position apart from the cut line 55). The printing tape 50 is formed by laminating the printing sheet 52 having the configuration illustrated in FIG. 16B on the release sheet 54 having the configuration illustrated in FIG. 16C (see the white arrow in the drawing).

Thus, with the above configuration of the printing tape 50, when peeling off the label portion 95 (winding part 90 and label main body part 91) from the printing sheet 52 at the time of use, a user can peel off the label portion 95 while visually confirming the mark 56A corresponding to the position of the cut line 55 on the printing sheet 52. Further, the mark 56A has the surrounding part 56A*a* that indicates the sides of the rectangular label portion 95 (winding part 90 and label main body part 91), allowing a user to grasp the shape of the label portion 95 and thus to peel off the label portion 95 reliably.

<Seventh Example of Mark>

Figure 17A:
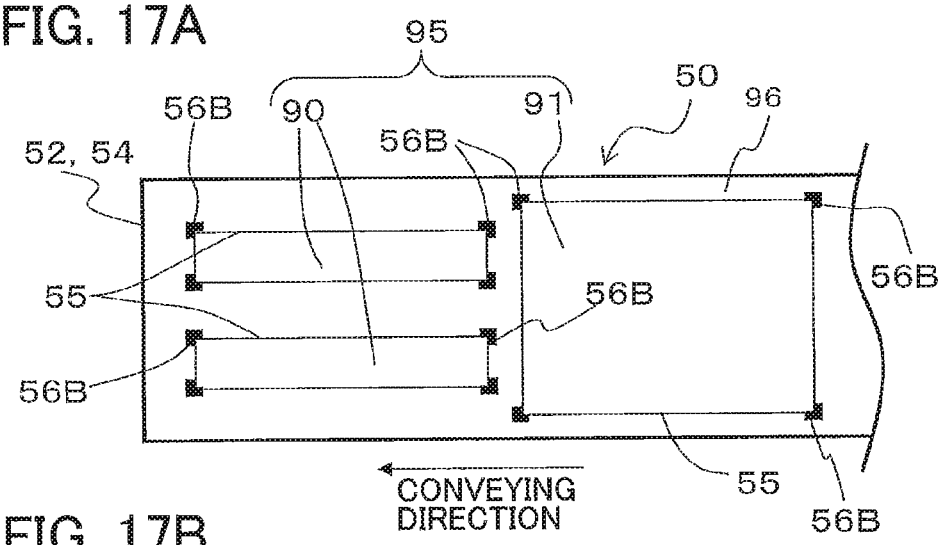
FIG. 17A is a schematic plan view illustrating a configuration of the printing tape in which the release sheet has another mark example printed thereon.
Figure 17B:
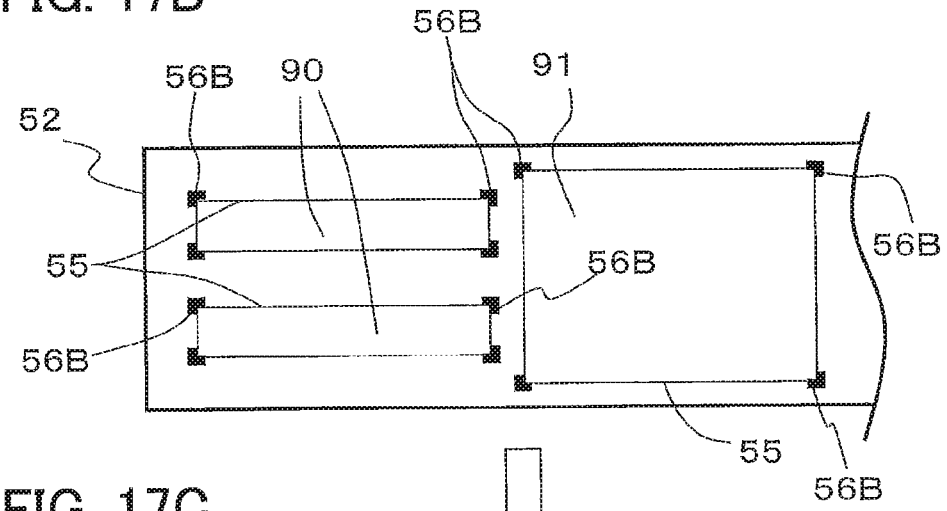
FIG. 17B is a schematic plan view illustrating the printing sheet extracted from the printing tape of FIG. 17A.
Figure 17C:
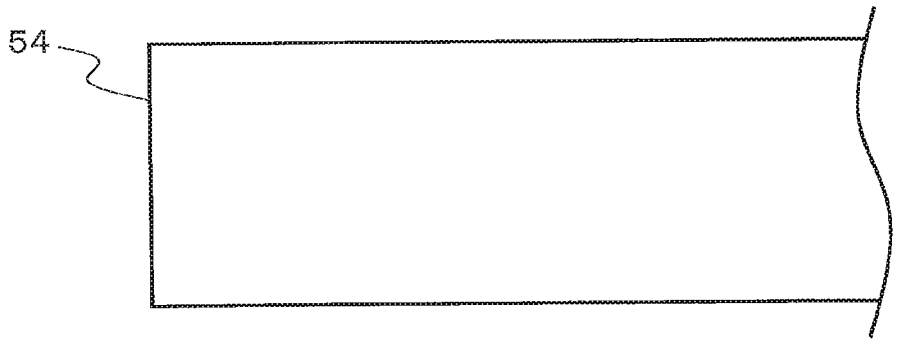
FIG. 17C is a schematic plan view illustrating the release sheet extracted from the printing tape of FIG. 17A.

FIGS. 17A to 17C illustrate another example of the mark according to the present embodiment. In this example, marks 56B are printed on the upper surface of the printing sheet 52 (specifically, the non-label portion 96) as in the sixth example. Like FIGS. 16A to 16C, FIG. 17A is a conceptual plan view illustrating the structure of the printing tape 50 in which the marks 56B are printed on the printing sheet 52, FIG. 17B is a conceptual plan view illustrating only the printing sheet 52 of the printing tape 50 illustrated in FIG. 17A, and FIG. 17C is a conceptual plan view illustrating only the release sheet 54 of the printing tape 50 illustrated in FIG. 17A.

As described using FIGS. 16A to 16C, the rectangular cut lines 55 constituting the outlines of the respective winding part 90 and label main body part 91 are formed on the printing sheet 52 (see FIG. 17B). As illustrated in FIG. 17B, in the illustrated range, 12 marks 56B in total are printed on the outer peripheral side of the four corners of each of the rectangular label portions 95 (two winding parts 90 and one label main body part 91) so as to indicate the four corners. While the four marks 56B are printed for each label portion 95 in the example of FIG. 17B, the number of the marks to be printed for each label portion 95 may be two (as illustrated in FIGS. 14A and 14C) or three (in this case, arbitrary one mark is omitted from among the four marks).

The marks 56B each have a substantially L-shape (which resembles Japanese quotation mark) in this example. However, although not particularly illustrated, each mark 56B may have a square bracket shape ("[" or]") or a bold black-lenticular bracket shape. Also in this example, the marks 56B are previously printed outside the winding part 90 and the label main body part 91 at, e.g., the factory production stage of the printing tape 50. As in the above examples, the printing tape 50 is formed by laminating the printing sheet 52 having the configuration illustrated in FIG. 17B on the release sheet 54 having the configuration illustrated in FIG. 17C (see the white arrow in the drawing).

In this example, when peeling off the label portion 95 (winding part 90 and label main body part 91) from the printing sheet 52 at the time of use, a user can easily peel off the winding part 90 and label main body part 91 starting from the corner of the rectangle while visually confirming the mark 56B roughly indicating the corner of the rectangular outline of each of the winding part 90 and label main body part 91.

<Eighth Example of Mark>

Figure 18A:
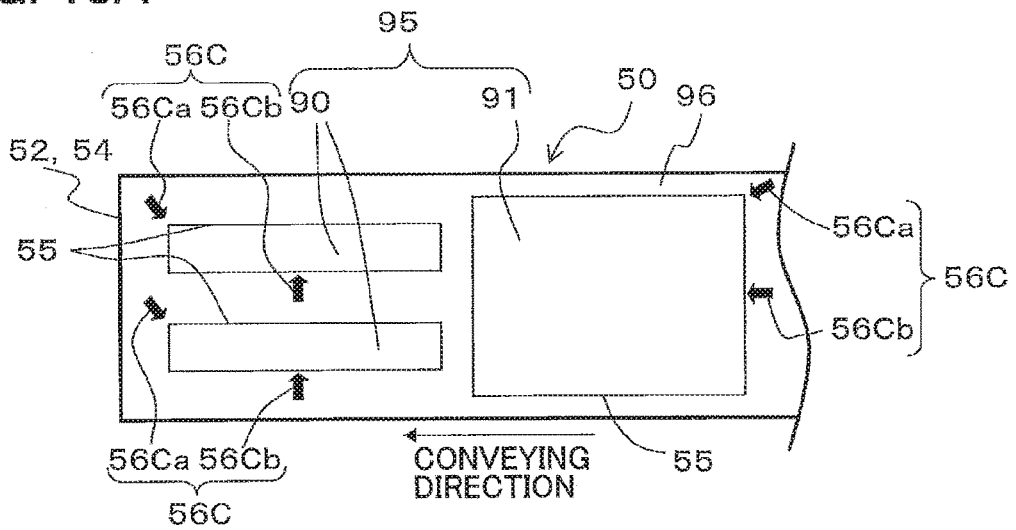
FIG. 18A is a schematic plan view illustrating a configuration of the printing tape in which the release sheet has another mark example printed thereon.
Figure 18B:
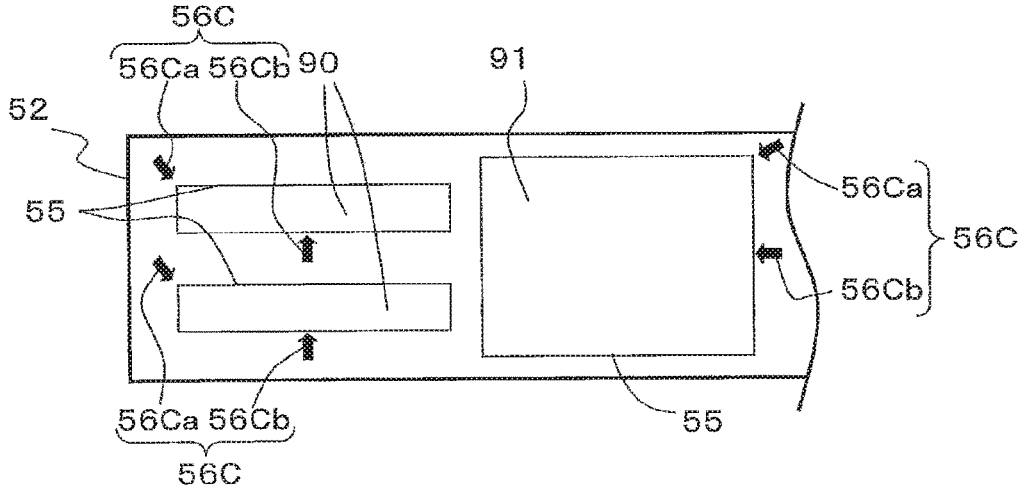
FIG. 18B is a schematic plan view illustrating the printing sheet extracted from the printing tape of FIG. 18A.
Figure 18C:
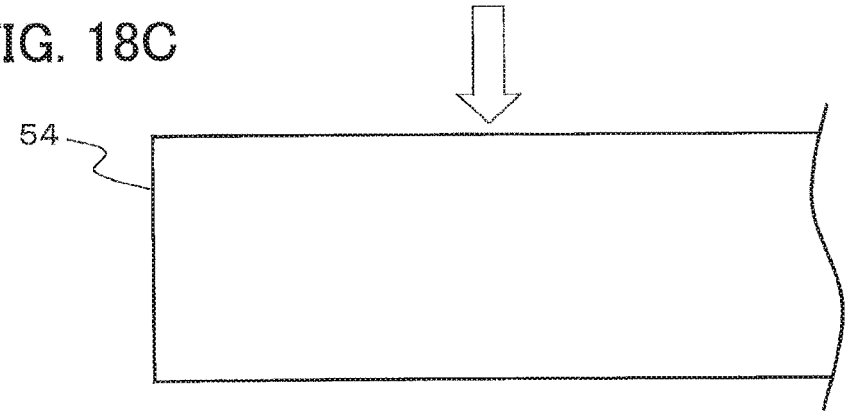
FIG. 18C is a schematic plan view illustrating the release sheet extracted from the printing tape of FIG. 18A.

FIGS. 18A to 18C illustrate still another example of the mark. In this example, marks 56C are printed on the upper surface of the printing sheet 52 (specifically, the non-label portion 96) as in the above examples. Like FIGS. 16A to 16C, FIG. 18A is a conceptual plan view illustrating the structure of the printing tape 50 in which the marks 56C are printed on the printing sheet 52, FIG. 18B is a conceptual plan view illustrating only the printing sheet 52 of the printing tape 50 illustrated in FIG. 18A, and FIG. 18C is a conceptual plan view illustrating only the release sheet 54 of the printing tape 50 illustrated in FIG. 18A.

As described using FIGS. 16A to 16C, the rectangular cut lines 55 constituting the outlines of the respective winding part 90 and label main body part 91 are formed on the printing sheet 52 (see FIG. 18B). Marks 56C of this example are printed on the upper surface of the printing sheet 52 (e.g., at the factory production stage of the printing tape 50). The marks 56C include arrows 56C*a* and 56C*b* for each of the two winding parts 90 and include arrows 56C*a* and 56C*b* for one label main body part 91. The arrow 56C*a* indicates one of the four corners of the rectangle at the outside of the area corresponding to the winding part 90 or the label main body part 91. The arrow 56C*b* indicates one of the four sides of the rectangle at the outside of the area corresponding to the winding part 90 or label main body part 91. As in the above examples, the printing tape 50 is formed by laminating the printing sheet 52 having the configuration illustrated in FIG. 18B on the release sheet 54 having the configuration illustrated in FIG. 18C (see the white arrow in the drawing).

In this example, when peeling off the label portion 95 (winding part 90 and label main body part 91) from the printing sheet 52 at the time of use, a user can easily peel off the winding part 90 and label main body part 91 starting from the corner or side of the rectangle while visually confirming the arrow 56C*a* indicating the position of the corner of the rectangular outline of each of the winding part 90 and label main body part 91 or the arrow 56C*b* indicating the position of the side of the rectangular outline of each of the winding part 90 and label main body part 91.

<Effects of Second Embodiment>

As described above, in the second embodiment, the marks 56 are previously printed on the non-label portion 96 of the printing sheet 52 at positions near the cut lines 55. Thus, a user can peel off the label portion 95 (winding part 90 and label main body part 91) from the release sheet 54 while visually confirming the marks 56. As a result, the label portion can be easily peeled off, thus enhancing user convenience.

Particularly in the present embodiment, the label portion 95 has a rectangular shape, and the arrow part 56A*b*, mark 56B, and arrow 56C*a* each indicate the corner of the corresponding label portion 95 (winding part 90 or label main body part 91). This allows the position of the indicated target (corner) to be made clear, thus allowing the rectangular label portion 95 to be easily peeled off starting from the corner.

Particularly, in the present embodiment, the marks 56B have an L-shape (which resembles Japanese quotation mark). This allows the corner position of the label portion 95, the shape thereof, and the direction thereof to be clearly indicated.

Particularly in the present embodiment, two or more marks 56 are printed for each label portion 95. This allows a user to roughly grasp the size of the label portion 95, thus enabling reliable peeling-off.

Particularly in the present embodiment, the label portion 95 has a rectangular shape, and the surrounding part 56A*a* or the arrow 56C*b* indicates the side of the corresponding label portion 95 (winding part 90 or label main body part 91). This allows the position of the indicated target (side) to be made clear, thus allowing the substantially rectangular label portion 95 to be easily peeled off starting from the side.

Particularly, in the present embodiment, the surrounding part 56A*a* has a rectangular shape that borders one rectangular cut line 55. This allows the shape of the rectangular label portion 95 to be peeled off to be made visually clear.

Particularly, in the present embodiment, the marks 56 are printed at positions apart from the cut lines 55. Thus, no mark 56 exists in the peeled-off label portion 95 (winding part 90 or label main body part 91), allowing the appearance of the label portion to be improved.

Next, a third embodiment of the present disclosure will be described with reference to FIGS. 19 to 24. In the third embodiment, the same reference numerals are given to the same parts as in the first and second embodiments, and a detailed description thereof will be omitted or simplified as needed.

In the present embodiment, none of the marks 56 and marks 57 are printed on the printing tape 50, but the marks are newly printed on the printing tape 50 by the above-described printing apparatus 1. That is, the marks 56 or marks 57 are printed on the upper surface (printing surface) of the printing sheet 52 by the thermal head 22. At the same time, the above-described printings R1 and R2 are formed on the label main body part 91 together with the marks 56 or marks 57.

It is assumed hereinafter that the marks 56A illustrated in FIG. 16A and printings R1 and R2 illustrated in FIGS. 6A, 6B, 7A, and 7B are formed on the printing tape 50.

Figure 19:
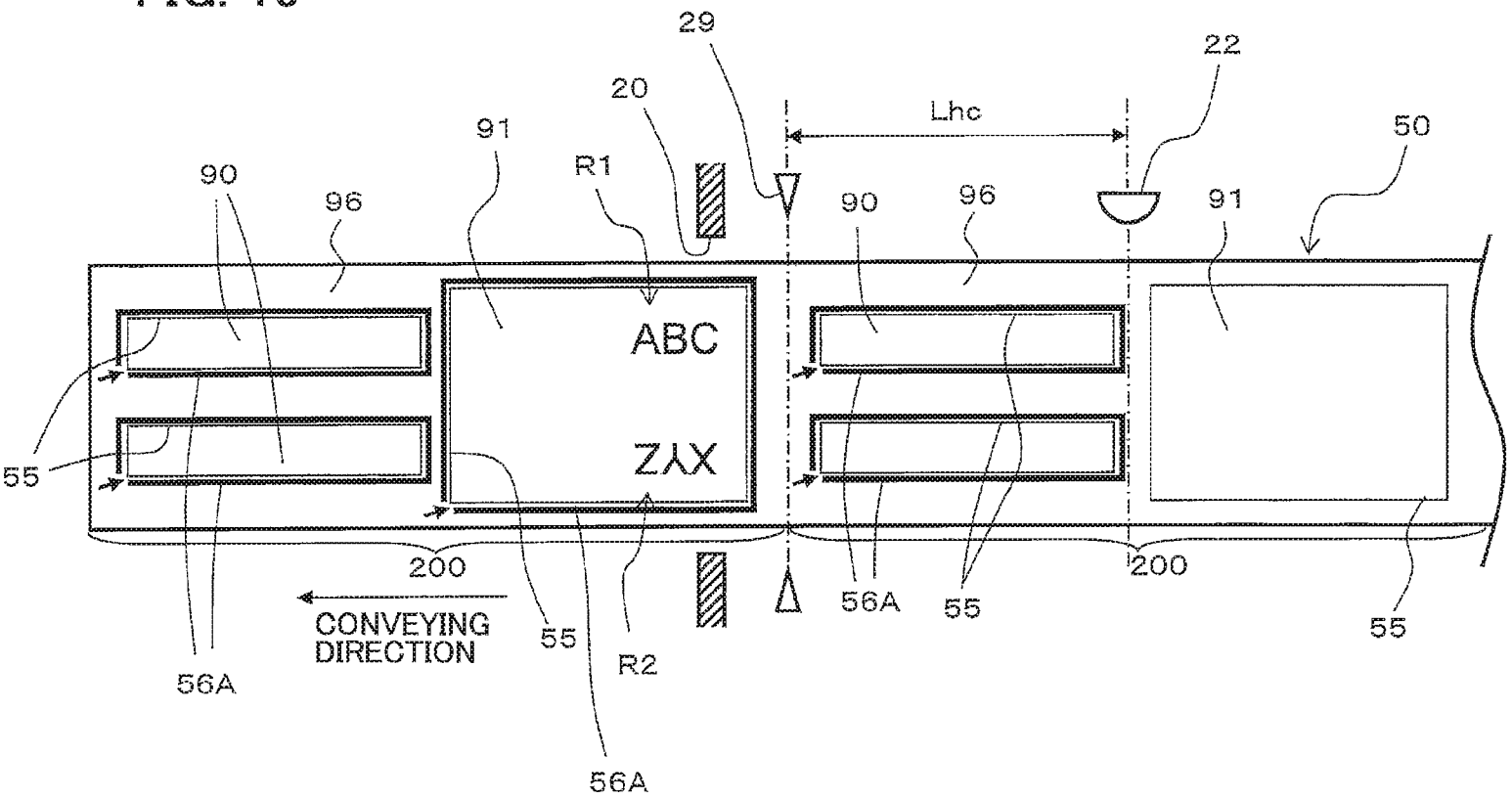
FIG. 19 is an explanatory view explaining printing process of marks and dimensions of portions in a case where a printing apparatus prints the marks according to a third embodiment of the present disclosure.

There is a need to devise a proper way for the printing process of the marks 56A because of the structural reason of the printing apparatus 1. That is, for example, assumed is a case where the printings R1 and R2 are formed on the printing tape 50 by the printing apparatus 1 together with the marks 56A using the above-described technique to create one printing label 200 including the two winding parts 90 (corresponding to second label portions), one label main body part 91 (corresponding to a first label portion), and the non-label portion 96 surrounding the winding parts 90 and the label main body part 91, as illustrated in FIG. 19. In this case, in the printing apparatus 1, a certain degree of clearance Lhc is inevitably formed between the thermal head 22 and the cutter 29 which are disposed along the conveying path of the printing tape 50. Thus, at a time point when the rear end (positioned slightly upstream of the label main body part 91 in the conveying direction) of the printing label 200 created first reaches the position facing the cutter 29, a part (winding part 90 in the illustrated example) of the printing label 200 following the printing label 200 created first (in other words, printing label to be created next) has already passed through the position facing the thermal head 22. As a result, the marks 56A cannot be printed on the part (winding part 90 in the illustrated example) that has already passed through the thermal head 22.

Thus, in the present embodiment, simultaneously with the printing of the marks 56A on the positions near the cut lines 55 of the two winding parts 90, 90 and one label main body part 91 (corresponding to one preceding label set) of the printing label 200 (left-side printing label 200 in FIG. 19) created first, the marks 56A are printed (see the state illustrated in FIG. 19) on the positions near the cut lines 55 of the two winding parts 90, 90 and one label main part 91 (corresponding to a succeeding label set) of the next printing label 200 (right-side printing label 200 in FIG. 19). As a result of repetition of the above process, when printing is performed on one printing label 200 (in this printing label 200, the printing of the marks for the winding parts 90, 90 has been finished in the preceding printing). Further, printing (the printing of the marks 56A and the forming of printings R1 and R2 in this example) on the label main body part 91 of the one printing label 200 and printing for the two winding parts 90, 90 (the printing of the marks 56A in this example) of the succeeding printing label 200 are performed.

<Control Procedure Executed by Printer>

A flowchart of a control procedure that the CPU 82 of the printing apparatus 1 executes for realizing the above printing process is illustrated in FIG. 20. The flowchart illustrated in FIG. 20 is started when, for example, an instruction to create one printing label 200 is inputted to the printing apparatus 1.

In step S105, the CPU 82 outputs a control signal to the drive motor 66 through the drive circuit 62 to start drawing out the printing tape 50 from the printing tape roll 51, i.e., conveyance of the printing tape 50.

Thereafter, in step S110, the CPU 82 determines whether or not the position of the conveyed printing tape 50 reaches a printing area start position of the label main body part 91. In other words, the CPU 82 determines whether or not the printing area start position of the label main body part 91 reaches a position facing the thermal head 22. When the position of the conveyed printing tape 50 has not reached the printing area start position of the label main body part 91, the determination is not satisfied, and the CPU 82 waits in a loop while continuing to convey the tape. The position of the conveyed printing tape 50 is detected by a known method based on a detection timing of the sensor mark 59 by the optical sensor 65.

On the other hand, when the position of the conveyed printing tape 50 reaches the printing area start position of the label main body part 91, the determination of step S110 is satisfied, and the processing proceeds to step S115.

In step S115, the CPU 82 outputs a control signal to the thermal head 22 through the drive circuit 61 to perform the printing of the marks 56A corresponding to the cut line 55 of the label main body part 91 in parallel with the forming of the printings R1 and R2 on the inside of the label main body part 91 (hereinafter, referred to merely as "internal printing").

Thereafter, in step S120, the CPU 82 determines whether or not the position of the conveyed printing tape 50 reaches the printing area start position of the winding part 90 of the next printing label 200. When the position of the conveyed printing tape 50 does not reach the printing area start position of the winding part 90, the determination is not satisfied, and the CPU 82 waits in a loop while continuing to convey the tape.

On the other hand, when the position of the conveyed printing tape 50 reaches the printing area start position of the winding part 90, the determination of step S120 is satisfied, and the processing proceeds to step S125.

In step S125, the CPU 82 outputs a control signal to the thermal head 22 through the drive circuit 61 to print the marks 56A corresponding to the winding parts 90.

Thereafter, in step S130, the CPU 82 determines whether or not the position of the conveyed printing tape 50 reaches the cut position. In other words, the CPU 82 determines whether or not a predetermined portion (cut position) between the label main body part 91 printed in step S115 and the winding parts 90 printed in step S125 reaches the position facing the cutter 29. When the position of the conveyed printing tape 50 does not reach the cut position, the determination is not satisfied, and the CPU 82 waits in a loop while continuing to convey the tape.

On the other hand, when the position of the conveyed printing tape 50 reaches the cut position, the determination of step S130 is satisfied, and the processing proceeds to step S135.

In step S135, the CPU 82 stops the driving of the drive motor 66 through the drive circuit 62 to stop conveying the printing tape 50.

Then, in step S140, the CPU 82 displays information that indicates the completion of the printing and a message prompting a user to cut the printing tape 50 through an operation of the cutter button, and this routine is ended.

<Example of Display Screen of Operation Terminal>

In the present embodiment, the printing apparatus 1 is used to print the mark on the printing tape 50, so that a user can optionally edit a printing form (presence/absence of the mark, shape of the mark, etc.) concerning the mark. The editing of the printing form can be performed, together with the editing of the internal printing inside the label main body part 91, by using, e.g., the application program 320 (see FIG. 4) started in the operation terminal 300.

Figure 21:
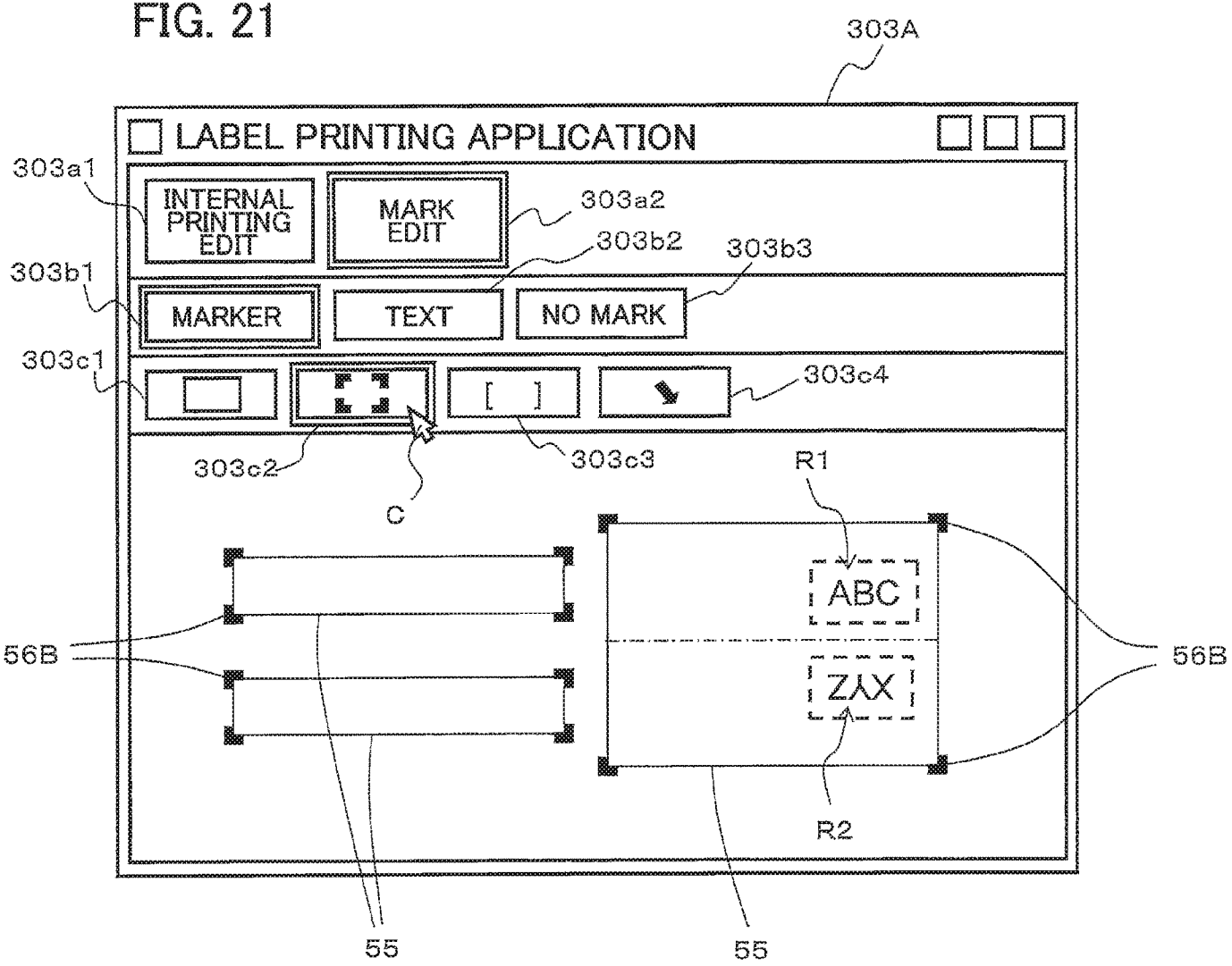
FIG. 21 is an example of a display of a display unit in an operation terminal during an editing operation of marks.

FIG. 21 illustrates an example of a display screen 303A on the display unit 303 of the operation terminal 300 during the editing performed by the application program 320. In the example of FIG. 21, the display screen 303A is provided with an "internal printing edit" button 303*a*1 for selecting an internal printing edit mode that edits the internal printing and a "mark edit" button 303*a*2 for selecting a mark edit mode that edits the mark. In the illustrated example, a user appropriately operates the operation unit 302 of the operation terminal 300 to move a cursor C on the display screen 303A and clicks the "mark edit" button 303*a*2, whereby the mark edit mode is selected.

When the mark edit mode is thus selected, a "marker" button 303*b*1 for displaying the mark in a graphical manner and a "text button" 303*b*2 for displaying the mark as text (the details thereof will be described later) are displayed as illustrated. In the illustrated example, a user moves the cursor C in the above-described manner and clicks the "marker" button 303*b*1. At the same time, a "no mark" button 303*b*3 for not printing the mark is also displayed on the display screen 303A.

When the "marker" button 303*b*1 is thus operated, a button 303*c*1 for selecting the mark 56A having the surrounding part 56A*a*, a button 303*c*2 for selecting the mark 56B having substantially an L-shape (which resembles Japanese quotation mark), a button 303*c*3 for selecting the mark (not illustrated) having a square bracket shape ("[" or "]"), and a button 303*c*4 for selecting the arrow 56C as the mark are displayed as illustrated. In the illustrated example, a user moves the cursor C in the above-described manner and clicks the button 303*c*2.

In accordance with the click of the button 303*c*2, the layout of the marks 56B to be printed is previewed at the lower portion of the screen 303A. In the present embodiment, the printing of the marks 56 or marks 57 is executed in a form of reflecting a result of editing (in other words, in a form corresponding to the preview) on the screen 303A that is transmitted to the printing apparatus 1.

Although not included in the above operation and display contents, when the mark edit mode is selected, and the "marker" button 303*b*1 or "text button" 303*b*2 is clicked, an appropriate display of, e.g., a mark position setting button may be done. Further, a mark formation position in the corresponding label portion 95 (winding part 90 or label main part 91) may be set according to a click of the button. This allows a user to optionally specify the presence/absence, position, and shape of the mark 56 or mark 57.

<Case Where Mark Formation is Omitted Automatically>

Figure 22A:
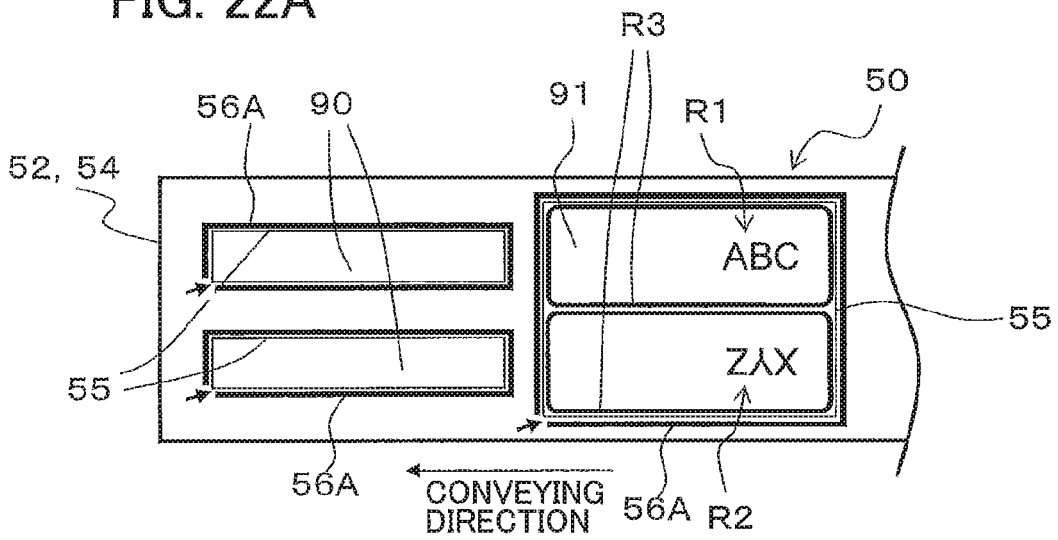
FIGS. 22A and 22B are explanatory views in a case where the mark printing is automatically omitted.
Figure 22B:
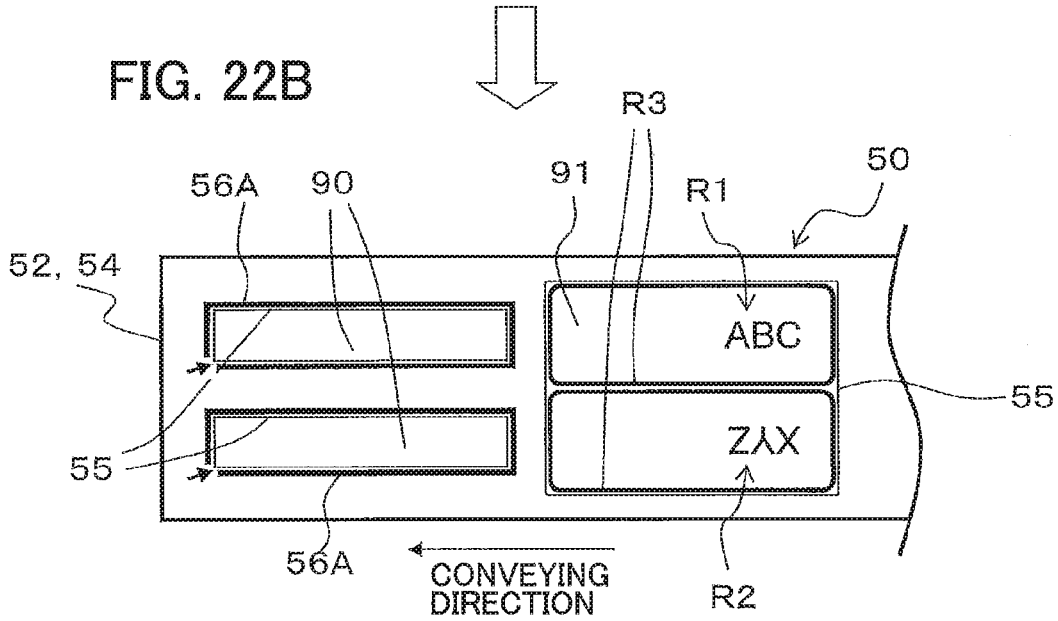

In the editing based on the screen 303A, when the "no mark" button 303*b*3 is not clicked (when the "marker" button 303*b*1 or "text button" 303*b*2 is clicked), a mark of any form is printed in principle. However, when, for example, a printing R3 of a form (a frame shape bordering the outer edge of the label main body part 91) similar to the mark 56A is printed inside the label main body part 91 according to the editing by a user, a printing similar to the mark is superimposed on the mark as illustrated in FIG. 22A, so that the mark and printing are hardly distinguished. Thus, in such a case, the printing of the mark 56A for the label main body part 91 may be automatically omitted under the control of the CPU 82 (irrespective of the click operation) as illustrated in FIG. 22B. In this case, visual confusion between the likenesses (frame-shaped printing R3 and mark 56A) caused due to overlapping with each other can be avoided.

<Example of Mark Using Text Characters>

Figure 23:
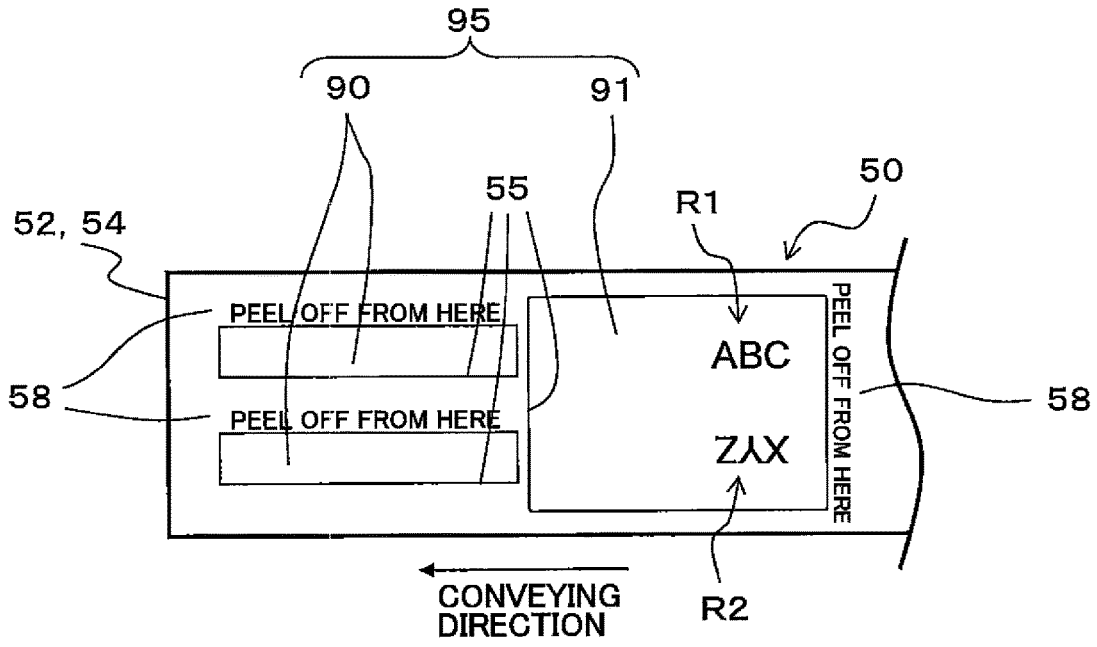
FIG. 23 is an explanatory view in a case where text characters are printed as marks.

In the present embodiment, the mark is not limited to the graphic mark (mark 56, mark 57) generated according to click of the button 303*b*1, but text characters may be printed as the mark. For example, as illustrated in FIG. 23, a mark text 58 ("peel off from here" in the illustrated example) is printed near the outer periphery of the cut line 55 of each label portion 95 (winding part 90 and label main body part 91), whereby information indicating that the label portion 95 can be peeled off and the position of the cut line 55 serving as the peeling-off start point can be shown at the same time.

Figure 24:
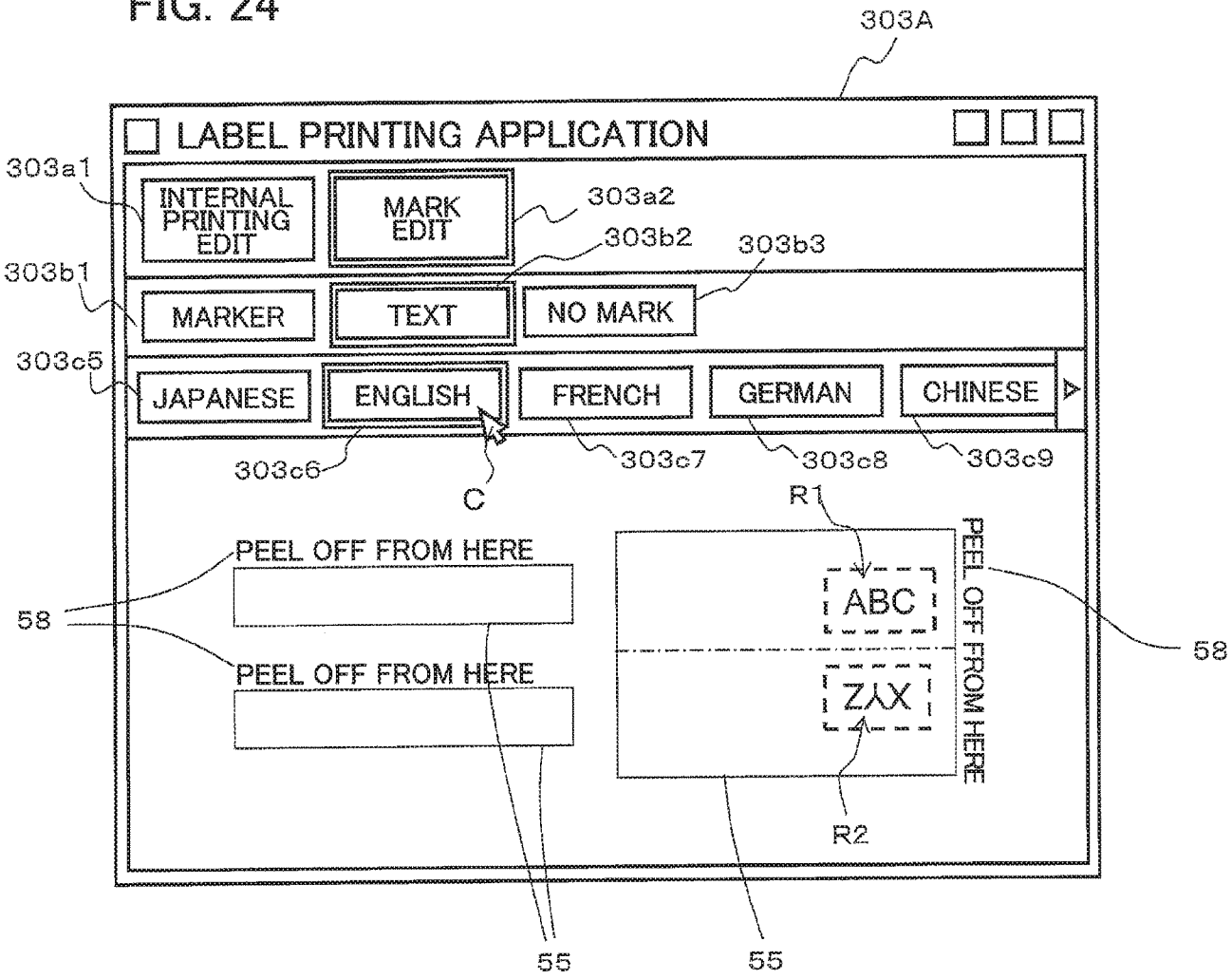
FIG. 24 is an example of the display of the display unit in the operation terminal during the editing operation of marks.

The content of the mark text 58 may be selected from among a number of routine phrases previously prepared by the application program 320, or a user may arbitrarily input the content. Further, the routine phrases used for the mark text 58 may be previously prepared in multiple languages on the application program 320. FIG. 24 illustrates an example of a display screen 303B on the display unit 303 in this case. In FIG. 24, the display screen 303B is provided with an "internal printing edit" button 303*a*1 and a "mark edit button" 303*a*2 which are similar to those provided in the screen 303A. In the illustrated example, a user moves the cursor C in the above-described manner and clicks the "mark edit" button 303*a*2, whereby the mark edit mode is selected.

When the "mark edit" mode is thus selected, the "marker" button 303*b*1, "text button" 303*b*2, and "no mark" button 303*b*3 are displayed as in the case of the screen 303A. In the illustrated example, a user moves the cursor C in the above-described manner and clicks the "text button" 303*b*2.

When the "text button" 303*b*2 is thus selected, a "Japanese" button 303*c*5 for displaying the routine phrase in Japanese, an "English" button 303*c*6 for displaying the routine phrase in English, a "French" button 303*c*7 for displaying the routine phrase in French, a "German" button 303*c*8 for displaying the routine phrase in German, a "Chinese" button 303*c*9 for displaying the routine phrase in Chinese, □□□ are displayed. In the illustrated example, a user moves the cursor C in the above-described manner and clicks the "English" button 303*c*6.

According to the click of the button 303*c*6, the layout of the mark texts 58 to be printed using English is previewed at the lower portion of the screen 303B. As can be seen from a comparison between previews of FIGS. 23 and 24, the mark text 58 displayed in Japanese is changed into English. As the above, the printing of the English mark texts 58 is executed in a form of reflecting a result of editing (in other words, in a form corresponding to the preview) on the screen 303B that is transmitted to the printing apparatus 1.

In the above examples, the editing is made through the operation of the operation unit 302 performed according to the display on the display unit 303 of the operation terminal 300; however, the present disclosure is not limited to this, and the editing may be performed on the printing apparatus 1 side. That is, the same contents are displayed on the display unit 64 of the printing apparatus 1, and the editing is made through the operation of the operation unit 63 of the printing apparatus 1 performed according to the display. The operation unit 63 in this case corresponds to a first input part and a second input part described in the claims of the present disclosure.

The language used for the routine phrase may be optionally selected through a user's manual operation on the screen 303B of FIG. 24, but not limited to this. That is, the language may be automatically set according to e.g., use language set on the OS 310 of the operation terminal 300 and destination/specification information of the product (printing apparatus 1 connected to the operation terminal 300). In order to make the language of the mark text 58 correspond to the use language on the OS 310, the application program 320 may be used to acquire language information concerning the use language on the OS 310 and automatically set the language. Further, also in this case, the CPU 82 of the printing apparatus 1 may take on the role of the application program 320. That is, the CPU 82 may automatically acquire the use language set on the system of the printing apparatus 1 and destination/specification information of the printing apparatus 1 and automatically set the language according to the acquired information. The CPU 82 in this case corresponds to an acquisition part described in the claims of the present disclosure. In either case, printing of the mark text 58 using the set language is executed under the control of the CPU 82 of the printing apparatus 1. Thus, the mark text 58 can be automatically printed in a language corresponding to the use state of the printing apparatus 1 without user's setting operation.

<Effects of Third Embodiment>

As described above, in the present embodiment, the marks 56 or marks 57 are printed on the printing sheet 52 at positions near the cut lines 55 of the non-label portion 96 under the control of the CPU 82 of the printing apparatus 1. Thus, a user can peel off the label portion 95 (winding part 90 and label main body part 91) from the release sheet 54 while visually confirming the marks 56 or marks 57. As a result, the peeling-off can be easily made, thus enhancing user convenience.

Particularly in the present embodiment, the presence/absence and shape of the marks 56 or marks 57 can be specified according to the content of the printing on the label main body part 91. This can balance between the printing content inside the label main body part 91 and the mark 56 or 57 surrounding the label main body part.

<Others>

In the above description, a combination of the winding part 90 and the label main body part 91 formed into rectangles having mutually different sizes, which are used as the P-type label 92 or T-type label 93, is taken as the label portion; however, the present disclosure is not limited to this. Although not especially illustrated, the shape of the label portion may be a shape other than a rectangle, or a label portion of only one type may be used.

When the term "vertical", "parallel", or "plane" is used in the above description, the term is not used in a strict sense. That is, the term "vertical", "parallel", and "plane" refer to "substantially vertical", "substantially parallel", or "substantially plane", respectively, where design/manufacturing tolerance and error are allowed.

When the term "same", "equal", or "different" concerning the outer appearance or size is used in the above description, the term is not used in a strict sense. That is, the term "same", "equal", and "different" refer to "substantially same", "substantially equal", or "substantially different", respectively, where design/manufacturing tolerance and error are allowed.

However, the term "same", "equal", or "different" concerning a value used as a predetermined determination criterion or representing a predetermined range, such as a threshold value (see the flowchart of FIG. 20) or a reference value is used in a strict sense unlike the above.

In the above description, the arrows in FIG. 4 represent an example of the flow of a signal and do not limit the signal flow direction.

The flowchart illustrated in FIG. 20 does not limit the present disclosure to the illustrated processing flow, and addition/deletion and/or rearrangement of steps may be made to the processing flow without departing from the spirit and technical ideas of the disclosure.

Further, the various modifications and the methodologies described above may be suitably combined to utilize.

The present disclosure may be worked by making various changes within the spirit and scope of the disclosure.

What is claimed is:

1. A tape cartridge comprising:

a casing; and a tape roll which is a winding of a tape and is accommodated in the casing, the tape comprising:

a first sheet in a form of an elongated sheet-like shape having a first surface and a second surface opposite to the first surface, the first sheet having translucency; and a second sheet in a form of an elongated sheet-like shape and affixed to the first surface of the first sheet, the second sheet including a label portion and a non-label portion segmented from each other by a cut line, the second sheet having translucency, the second surface of the first sheet being provided with a mark at a position adjacent to the cut line.

2. The tape cartridge according to claim 1, wherein the mark has an end portion positioned in coincidence with the cut line.

3. The tape cartridge according to claim 1, wherein the label portion is rectangular in shape, the mark being indicative of an angled corner of the label portion.

4. The tape cartridge according to claim 3, wherein the mark has a first end portion and a second end portion, the first end portion being aligned with a first side of the label portion, and the second end portion being aligned with a second side of the label portion, the first side and the second side defining the angled corner of the label portion.

5. The tape cartridge according to claim 4, wherein the first end portion and the second end portion define an angled corner of the mark, the angled corner of the mark being aligned with the angled corner of the label portion.

6. The tape cartridge according to claim 4, wherein the mark is in a form of one of L-shaped quotation mark, an angled bracket, and a bold-faced bracket.

7. The tape cartridge according to claim 4, wherein at least two marks are provided with respect to the label portion which is singular.

8. The tape cartridge according to claim 3, wherein the mark is an arrow.

9. The tape cartridge according to claim 1, wherein the label portion is rectangular in shape, the mark being indicative of a side of the label portion.

10. The tape cartridge according to claim 1, wherein the mark is positioned in a region corresponding to the label portion.

11. The tape cartridge according to claim 1, wherein the second surface of the first sheet is provided with a sensor mark for optical detection;

wherein the label portion of the second sheet comprises a first label portion and a second label portion arrayed with each other in a longitudinal direction of the tape;

wherein the sensor mark comprises a first sensor mark and a second sensor mark arrayed with each other in the longitudinal direction of the tape; and wherein a distance between one end in the longitudinal direction of the first label portion and one end in the longitudinal direction of the first sensor mark is equal to a distance between one end in the longitudinal direction of the second label portion and one end in the longitudinal direction of the second sensor mark.

12. The tape cartridge according to claim 11, wherein the mark is positioned offset from a center of the sensor mark in the longitudinal direction of the tape, the center being positioned at a widthwise center of the tape.

13. The tape cartridge according to claim 11, wherein the mark is displaced from the sensor mark in the longitudinal direction of the tape.

14. The tape cartridge according to claim 11, wherein a length of the sensor mark in the longitudinal direction is greater than a length of the mark in the longitudinal direction.

15. The tape cartridge according to claim 11, wherein the casing comprises a side wall portion having a through-hole positioned in coincidence with a moving path of the sensor mark provided at the second surface of the first sheet; and wherein the mark is offset in the longitudinal direction of the tape from a center of the through-hole, the center being positioned at a widthwise center of the tape.

16. The tape cartridge according to claim 11, wherein the casing comprises a side wall portion having a through-hole positioned in coincidence with a moving path of the sensor mark provided at the second surface of the first sheet; and wherein the mark is offset from the through-hole in the longitudinal direction of the tape.

17. The tape cartridge according to claim 11, wherein a shape of the sensor mark is different from a shape of the mark.

* * * * *